US007660550B2

(12) United States Patent
Mori et al.

(10) Patent No.: US 7,660,550 B2
(45) Date of Patent: Feb. 9, 2010

(54) PROCESS CARTRIDGE AND IMAGE FORMING APPARATUS

(75) Inventors: Tomonori Mori, Numazu (JP); Masaaki Sato, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 11/939,971

(22) Filed: Nov. 14, 2007

(65) Prior Publication Data

US 2008/0138107 A1 Jun. 12, 2008

(30) Foreign Application Priority Data

Dec. 11, 2006 (JP) ..... 2006-333026
Oct. 25, 2007 (JP) ..... 2007-277091

(51) Int. Cl.
*G03G 15/00* (2006.01)

(52) U.S. Cl. ..... 399/111

(58) Field of Classification Search ..... 399/107, 399/110–114
See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,528,341 | A | 6/1996 | Shishido et al. | 355/200 |
| 5,585,889 | A | 12/1996 | Shishido et al. | 355/200 |
| 5,870,654 | A | 2/1999 | Sato et al. | 399/109 |
| 5,911,096 | A | 6/1999 | Batori et al. | 399/111 |
| 5,940,658 | A | 8/1999 | Yokoi et al. | 399/119 |
| 5,966,566 | A | 10/1999 | Odagawa et al. | 399/109 |
| 5,974,288 | A | 10/1999 | Sato | 399/119 |
| 6,075,957 | A | 6/2000 | Batori et al. | 399/114 |
| 6,104,894 | A | 8/2000 | Sato et al. | 399/106 |
| 6,131,007 | A | 10/2000 | Yamaguchi et al. | 399/256 |
| 6,131,011 | A | 10/2000 | Kojima et al. | 399/351 |
| 6,157,792 | A | 12/2000 | Mori et al. | 399/24 |
| 6,178,301 | B1 | 1/2001 | Kojima et al. | 399/98 |
| 6,185,390 | B1 | 2/2001 | Higeta et al. | 399/90 |
| 6,188,856 | B1 | 2/2001 | Sato | 399/119 |
| 6,266,503 | B1 | 7/2001 | Murayama et al. | 399/117 |
| 6,298,217 | B1 | 10/2001 | Murayama et al. | 399/358 |
| 6,314,266 | B1 | 11/2001 | Murayama et al. | 399/353 |

(Continued)

FOREIGN PATENT DOCUMENTS

| | | |
|---|---|---|
| JP | 2001-337511 | 12/2001 |

(Continued)

*Primary Examiner*—Hoang Ngo
(74) *Attorney, Agent, or Firm*—Fitzpatrick, Cella, Harper & Scinto

(57) ABSTRACT

An image forming apparatus includes a cartridge including an electrophotographic photosensitive member, a developing roller, a spacer movable between spacing and contacting positions for spacing apart and contacting the roller and member, and a receiver receiving a force spacing the roller from the member. The apparatus includes a mounter detachably mounting the cartridge, an abuter retracting the spacer from the spaced position when the mounter mounts the cartridge with the spacer at the spaced position, and a function member movable between a first position spacing the roller from the member by abutting the receiver with the cartridge mounted to the mounter and a second position contacting the roller to the member. When the mounter mounts the cartridge with the spacer at the spaced position, the abuter abuts the spacer retracting it from the spaced position after insertion so that the function member taking the first position abuts the receiver.

10 Claims, 19 Drawing Sheets

U.S. PATENT DOCUMENTS

| | | | | |
|---|---|---|---|---|
| 6,381,420 | B1 | 4/2002 | Sato et al. | 399/27 |
| 6,404,996 | B1 | 6/2002 | Mori et al. | 399/24 |
| 6,640,066 | B2 | 10/2003 | Sato | 399/106 |
| 6,690,902 | B2 * | 2/2004 | Noda et al. | 399/111 |
| 6,714,749 | B2 | 3/2004 | Sato et al. | 399/102 |
| 6,826,380 | B2 | 11/2004 | Karakama et al. | 399/111 |
| 6,895,199 | B2 | 5/2005 | Sato et al. | 399/111 |
| 6,898,399 | B2 | 5/2005 | Morioka et al. | 399/167 |
| 6,915,092 | B2 | 7/2005 | Yamaguchi et al. | 399/109 |
| 6,917,774 | B2 * | 7/2005 | Terada et al. | 399/111 |
| 6,937,832 | B2 | 8/2005 | Sato et al. | 399/111 |
| 7,149,457 | B2 | 12/2006 | Miyabe et al. | 399/114 |
| 7,155,140 | B2 | 12/2006 | Arimitsu et al. | 399/111 |
| 7,155,141 | B2 | 12/2006 | Sato et al. | 399/114 |
| 7,158,736 | B2 | 1/2007 | Sato et al. | 399/111 |
| 7,184,686 | B2 | 2/2007 | Kanno et al. | 399/111 |
| 7,200,349 | B2 | 4/2007 | Sato et al. | 399/111 |
| 7,224,925 | B2 | 5/2007 | Sato et al. | 399/263 |
| 7,231,164 | B2 | 6/2007 | Harada et al. | 399/106 |
| 7,283,766 | B2 | 10/2007 | Arimitsu et al. | 399/111 |
| 2006/0008289 | A1 | 1/2006 | Sato et al. | 399/106 |
| 2006/0177231 | A1 | 8/2006 | Mori et al. | 399/12 |
| 2006/0269318 | A1 | 11/2006 | Ueno et al. | 399/106 |
| 2008/0025757 | A1 | 1/2008 | Sato et al. | 399/111 |

FOREIGN PATENT DOCUMENTS

| | | |
|---|---|---|
| JP | 2002-6722 | 1/2002 |
| JP | 2006-276190 | 10/2006 |

* cited by examiner

PROCESS CARTRIDGE AND IMAGE FORMING APPARATUS

FIELD OF THE INVENTION AND RELATED ART

The present invention relates to a process cartridge, and an image forming apparatus which employs a process cartridge.

Here, an electrophotographic image forming apparatus is an apparatus which forms an image on recording medium with the use of an electrophotographic image forming apparatus. As examples of an electrophotographic image forming apparatus, there are an electrophotographic copying machine, an electrophotographic printer (for example, a laser beam printer, an LED printer, etc.), a facsimile machine, and a word processor, etc.

A process cartridge is a cartridge in which at least a developing means and an electrophotographic photosensitive drum are integrally disposed. Some process cartridges are removably mountable in the main assembly of an electrophotographic image forming apparatus.

Further, some electrophotographic color image forming apparatuses in accordance with the prior art employ multiple process cartridges, which are arranged side by side in parallel in a straight row (which henceforth is referred to as inline type apparatus) in the main assembly of the image forming apparatus. As one of the methods used by a developing means in a process cartridge, a developing method of the so-called contact type has been known, according to which a latent image on the photosensitive member in a process cartridge is developed with the development roller placed in contact with the photosensitive drum. In the case of a process cartridge employing this developing method, the development roller is kept pressured toward the photosensitive drum, in order to keep the development roller in contact with the photosensitive drum, and maintain a preset amount of pressure between the development roller and photosensitive drum.

Generally, a development roller used for a developing method of the contact type is provided with an elastic layer. Thus, if a cartridge used for the developing method of the contact type is left unused for a substantial length of time in the main assembly of an image forming apparatus, the portion of the elastic layer, which is in contact with the photosensitive drum, sometimes deforms, which results in the formation of an image which is non-uniform in density or the like. In order to prevent this problem, not only must the materials for a development roller be very strictly selected, but also, the conditions under which a development roller is manufactured must be strictly controlled. In other words, this deformation of the elastic layer of a development roller has been a serious concern with the manufacturing of a development roller.

Thus, there has been proposed a process cartridge and an image forming apparatus, which are provided with a mechanism for keeping the development roller separated from the photosensitive drum while the image forming apparatus is not used for image formation (Japanese Laid-open Patent Application 2001-337511 (p. 5-p. 6, FIG. 2).

There has also been proposed a process cartridge and an image forming apparatus, which are structured to keep the development roller separated from the photosensitive drum with the use of a separating member while the process cartridge is not in use (Japanese Laid-open Patent Application 2002-6722).

Moreover, there has been developed a process cartridge provided with a member for keeping the development roller separated from the photosensitive member, in the process cartridge during the shipment of the process cartridge (this member hereafter may be referred to simply as a separating member). In the case of this process cartridge, as the process cartridge is inserted (mounted) into an image forming apparatus compatible with the process cartridge, the separating member comes into contact with the separating member disengaging portion of the main assembly of the image forming apparatus, and is disengaged by the further insertion of the process cartridge.

In the case of a process cartridge and an image forming apparatus, which are in accordance with the prior art described above, while the process cartridge is mounted into the image forming apparatus, first, the separating member comes into contact with the separating member disengaging portion of the main assembly of the image forming apparatus, and then, is disengaged by the further insertion of the process cartridge, allowing the development unit to move from the position in which it keeps the development roller separated from the photosensitive drum, to the position in which it keeps the development roller in contact with the photosensitive drum. Further, the development unit is always under the pressure from the pressure applying members. Therefore, as the separating member becomes disengaged, the development roller virtually collides with the photosensitive member, generating thereby a substantial amount of shock, and this shock is transmitted to the user who is mounting the process cartridge. Therefore, a process cartridge and an image forming apparatus that are designed in accordance with the prior art do not offer a feel of smoothness to the user when the user is mounting the process cartridge into the image forming apparatus.

Also in the case of a process cartridge and an image forming apparatus designed in accordance with the prior art, after the separating member is moved out of the position in which it keeps the development roller separated from the photosensitive drum, the process cartridge must be inserted further in order to finish the operation for mounting the process cartridge. Further, before the end of the operation for mounting the process cartridge, the force bearing portion of the development unit must be moved onto the development roller separating means of the main assembly of the image forming apparatus, in order to move the development unit into the position in which it keeps the development roller separated from the photosensitive drum.

Therefore, in the case of the above described process cartridge and image forming apparatus, which are designed in accordance with the prior art, the process cartridge is subjected to two different kinds of loads, that is, the load to which it is subjected to disengage the separating member, and the load to which it is subjected at the end of the operation for mounting the process cartridge.

SUMMARY OF THE INVENTION

The present invention is one of the results of the further development of the prior art described above, and its primary object is to improve a process cartridge and an image forming apparatus, in terms of the operability regarding the mounting of the process cartridge into the main assembly of the image forming apparatus.

According to an aspect of the present invention, there is provided an electrophotographic image forming apparatus capable of forming an image on a recording material. The apparatus comprises a process cartridge including an electrophotographic photosensitive member, a developing roller contactable to the electrophotographic photosensitive member, a spacer member movable between a spacing position for spacing the developing roller from the electrophotographic photosensitive member and a contacting position for contacting the developing roller to the electrophotographic photosensitive member, and a force receiving portion for receiving a force for spacing the developing roller from the electrophotographic photosensitive member. The apparatus also comprises a mounting portion for detachably mounting the process cartridge, an abutting member for retracting the spacer member from the spaced position by abutting the spacer member when the process cartridge is inserted into the mounting portion with the spacer member at the spaced position, and function member movable between a first position for spacing the developing roller from the electrophotographic photosensitive member by abutting to the force receiving portion with the process cartridge mounted to the mounting portion and a second position for contacting the developing roller to the electrophotographic photosensitive member. When the process cartridge is inserted into the mounting portion with the spacer member at the spaced position, the abutting member is abutted to the spacer member to retract the spacer member from the spaced position after the process cartridge is inserted into the mounting portion to such a position where the function member taking the first position is abuttable to the force receiving portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1:
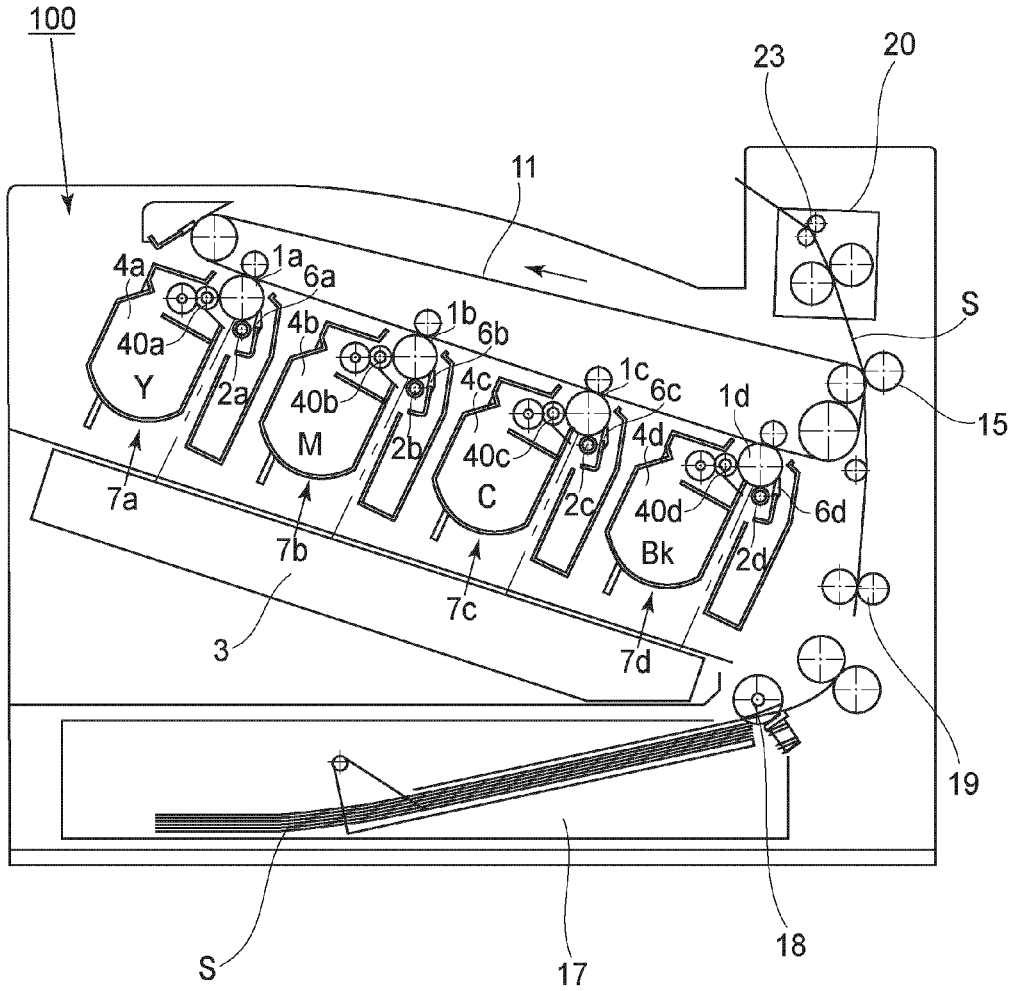
FIG. 1 is a sectional view of the image forming apparatus in the first embodiment of the present invention, showing the overall structure of the apparatus.

Next, the process cartridge and the image forming apparatus in the first of the preferred embodiments of the present invention will be described with reference to the appended drawings. FIG. 1 is a sectional view of the image forming apparatus in the first embodiment, showing the overall structure of the apparatus.

(Overall Structure of Image Forming Apparatus)

Figure 5:
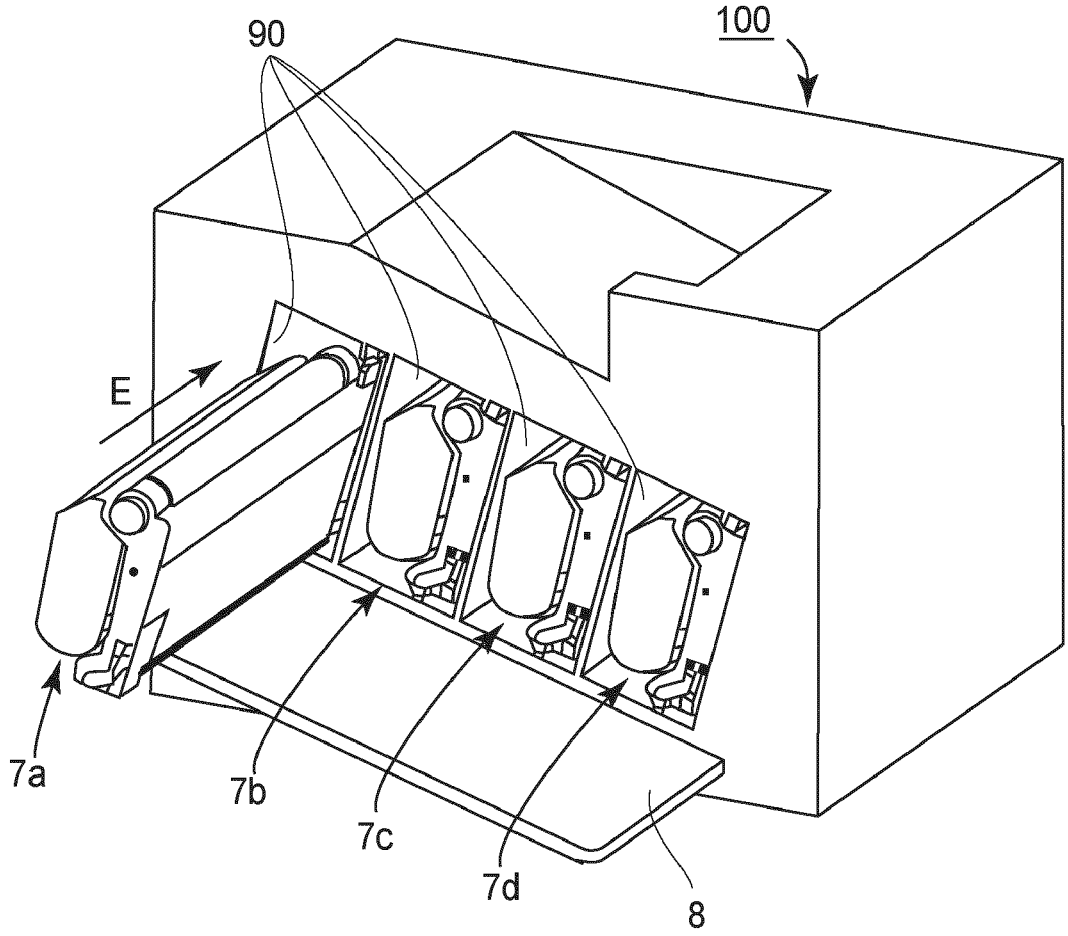
FIG. 5 is a perspective view of the image forming apparatus in the first embodiment, in which one of the process cartridges is at the entrance of the corresponding cartridge bay in the image forming apparatus, being ready to be mounted into the apparatus.

First, the overall structure of the image forming apparatus will be described. The image forming apparatus 100 shown in FIG. 1 has four process cartridge bays (unshown). FIG. 5 is a perspective view of the image forming apparatus in the first embodiment, in which one of the process cartridges is at the entrance of the corresponding cartridge bay in the image forming apparatus, being ready to be mounted into the apparatus.

Referring to FIG. 5, the process cartridges 7 (7*a*-7*d*) are removably mountable in the process cartridge bays 90 of the main assembly of the image forming apparatus 100, respectively. In order to mount the cartridge 7 in the image forming apparatus 100, first, the front cover 8 with which the main assembly of the image forming apparatus 100 is provided must be opened, and then, the process cartridge 7 must be inserted into the main assembly in the preset direction (indicated by arrow mark E). That is, the process cartridge 7 is structured so that it can be removably mounted in the process cartridge bay 90. Each cartridge 7 has a photosensitive member unit 26, and a development unit 4 (4*a*-4*d*) (second unit). The development unit 4 has a development roller 40(40*a*-40*d*). The photosensitive member unit 26 has a charge roller 2 (2*a*-2*d*), a cleaning member 6 (6*a*-6*d*), and a photosensitive drum 1 (1*a*-1*d*) as an electrophotographic photosensitive member.

The image forming operation of the image forming apparatus is as follows: Each photosensitive member is rotated, it is uniformly charged by the charge roller 2. Then, the numerous points of the uniformly charged peripheral surface of the photosensitive drum 1 are selectively exposed by a scanner unit 3. As a result, an electrostatic latent image is formed on the photosensitive drum 1. Then, the electrostatic latent image is developed by the development roller 40 as a developing member. As a result, four visible images, different in color, are formed on the photosensitive drums, one for one; four images are formed of developer (toner), different in color, on the photosensitive drums, one for one.

Meanwhile, recording sheets S in a cassette 17 in the bottom portion of the main assembly of the image forming apparatus 100 are sent one by one by a feed roller 18, and a pair of conveyance roller 19, to the nip formed by a transfer belt 11 and a secondly transfer roller 15. In this nip, the four toner images, different in color, on the transfer belt 11 are transferred onto the recording sheet S.

After the transfer of the toner images, the recording sheet S is subjected to heat and pressure in a fixing portion 20. As a result, the toner images are fixed. Thereafter, the recording sheet S is discharged from the image forming apparatus 100 by a pair of discharge rollers 23.

(Process Cartridge)

Figure 2:
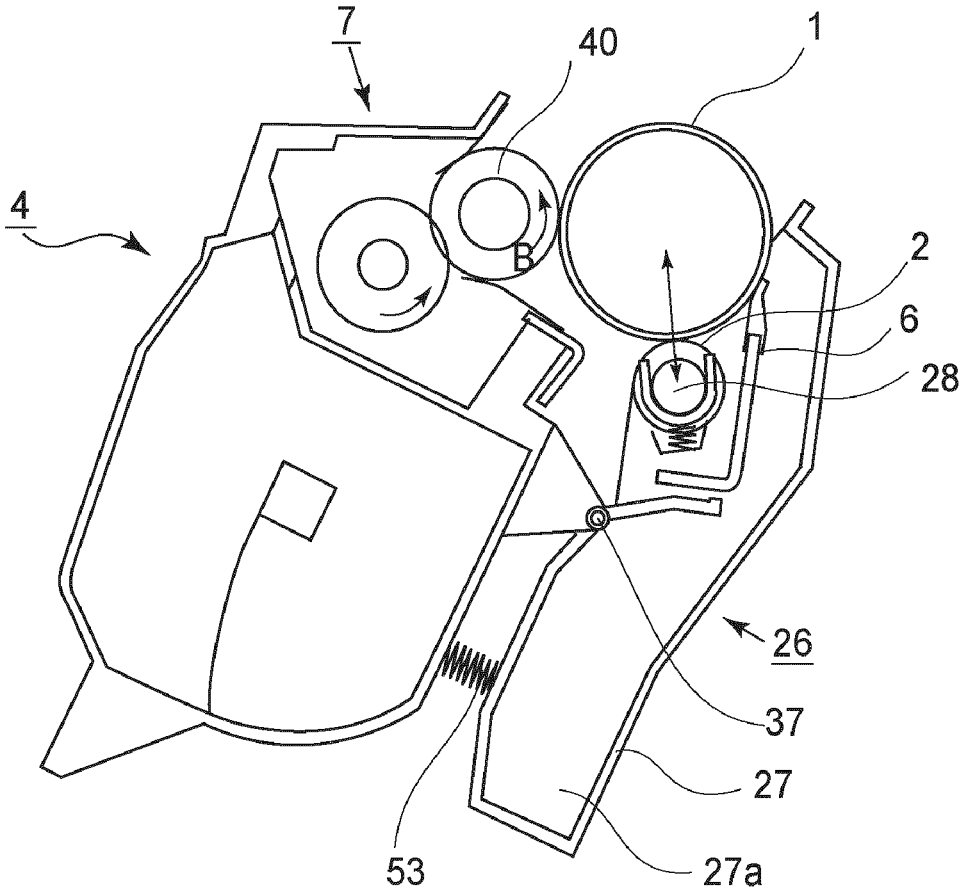
FIG. 2 is a cross-sectional view of the process cartridge in the first embodiment of the present invention.

Next, the process cartridges 7 will be described. FIG. 2 is a cross-sectional view of the cartridge 7 in which developer (toner) is stored. In this embodiment, the cartridges 7*a*-7*d* are the same in structure. The cartridges 7*a*-7*d* store yellow, magenta, cyan, and black toners, respectively.

Referring to FIG. 2, the cartridges 7 (7*a*-7*d*) are made up of the photosensitive member unit 26 (first unit), and the development unit 4 (4*a*-4*d*), which are in connection to each other.

The photosensitive member units 26 have the photosensitive drums 1 (1*a*-1*d*), the charge rollers 2 (2*a*-2*d*), the cleaning members 6 (6*a*-6*d*), and the cleaning means frames 27, respectively. The photosensitive drum 1 is rotatably supported by the cleaning means frame 27. The charge roller 2 and the cleaning member 6 are in the adjacencies of the peripheral surface of the photosensitive drum 1. The residual toner on the peripheral surface of the photosensitive drum 1 is removed by the cleaning member 6. As it is removed, it falls into a chamber 27*a* for the removed residual toner. The charge roller 2 is kept pressed toward the photosensitive drum 1.

The development roller 40 is supported by the development unit 4, and rotates in contact with the photosensitive drum 1, in the direction indicated by an arrow mark B. The development unit 4 is connected to the photosensitive member unit 26 with the use of a pair of connective pins 37, being thereby enabled to rotationally move (pivotally move) relative to the photosensitive member unit 26, about the pair of pins 37.

The development unit 4 can be pivotally moved into a position in which it keeps the development roller 40 in contact with the photosensitive drum 1, and a position in which it keeps a preset amount of distance between the development roller 40 and photosensitive drum 1. The development unit 4 is under the pressure applied by compression springs 53 (pressure applying members) in the direction to make the development unit 4 pivot into the abovementioned position in which it keeps the development roller 40 in contact with the photosensitive drum 1. Therefore, as the cartridge 7 begins to be used for an image forming operation, the development unit 4 rotates about the pair of connective pins 37, causing thereby the development roller 40 to come into contact with the photosensitive drum 1, because the development unit 4 is always under the abovementioned pressure.

(Mechanism for Keeping Development Roller 40 Separated from Photosensitive Drum when Process Cartridge 7 is in Apparatus Main Assembly)

Figure 3:
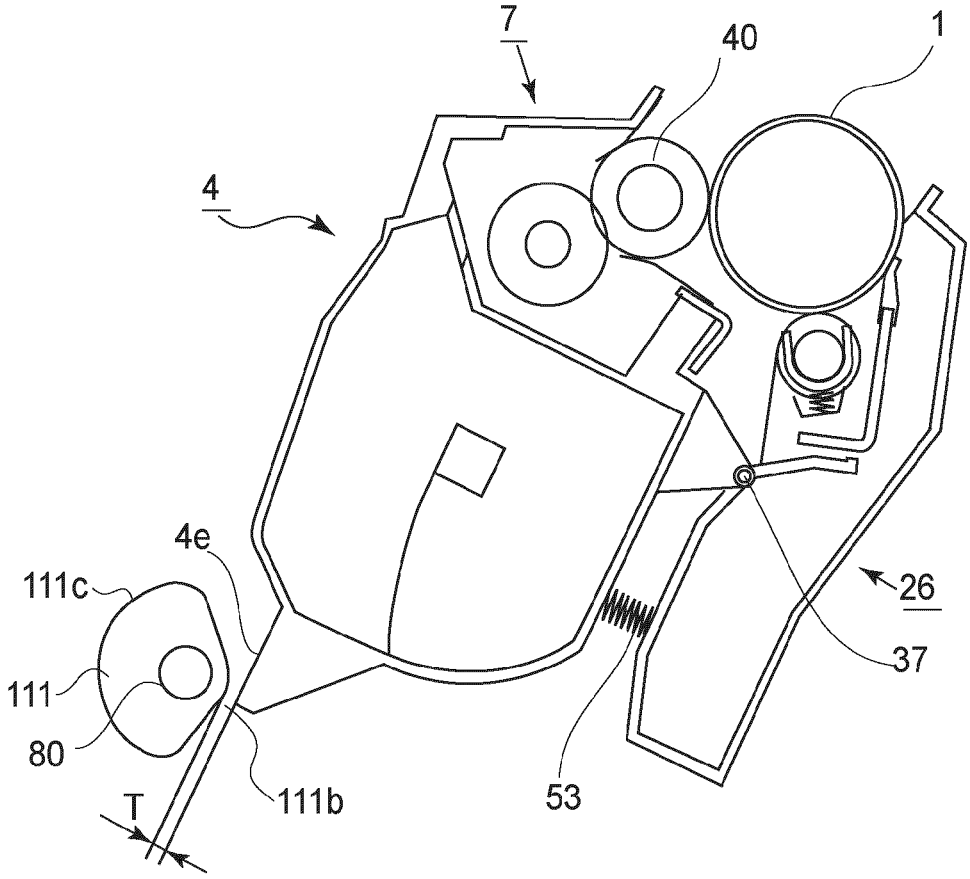
FIG. 3 is a cross-sectional view of the process cartridge in which the development roller is in contact with the photosensitive drum.
Figure 4:
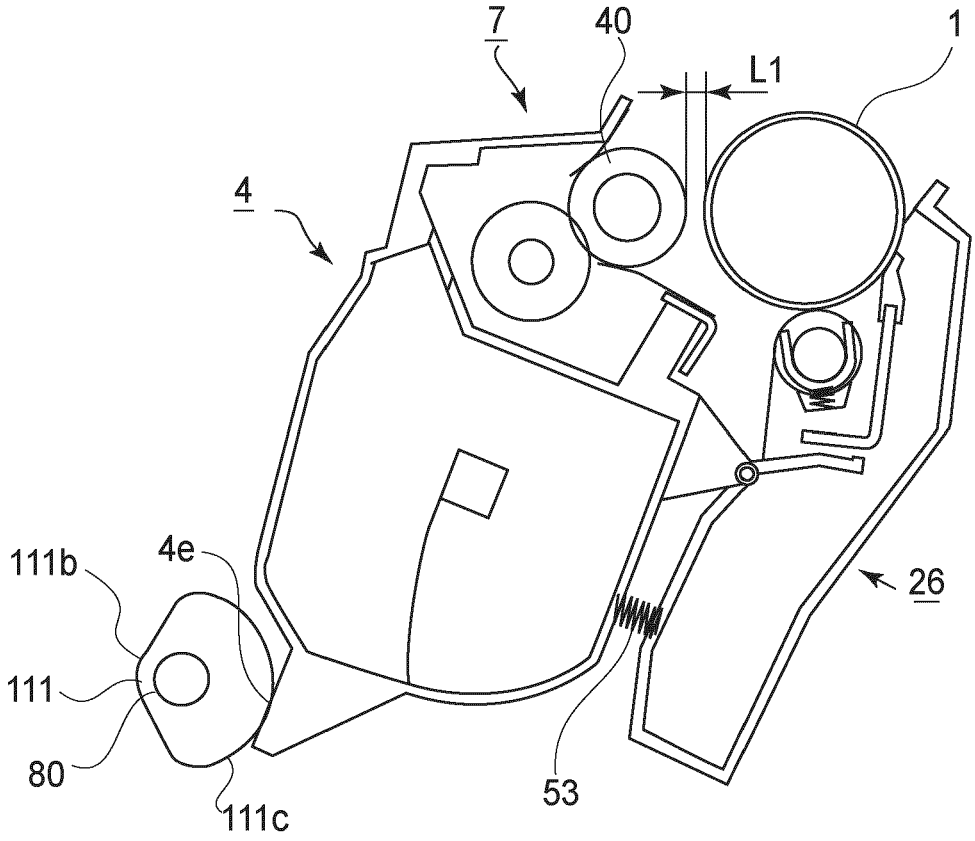
FIG. 4 is a cross-sectional view of the process cartridge in which a gap is present between the development roller and the photosensitive drum.

Next, the mechanism for keeping the development roller 40 separated from the photosensitive drum 1 after the completion of the operation for mounting the process cartridge 7 will be described. FIG. 3 is a cross-sectional view of the cartridge 7 which is in the cartridge bay 90 of the image forming apparatus, and a separation cam 111 with which the main assembly of the image forming apparatus 100 (which hereafter may be referred to simply as the apparatus main assembly) is provided. When the cartridge 7 is in the state shown in FIG. 3, the development roller 40 is in contact with the photosensitive drum 1. FIG. 4 is also a cross-sectional view of the cartridge 7, and the separation cam 111 of the apparatus main assembly, when the cartridge 7 is in the cartridge bay 90 of the apparatus main assembly. When the cartridge 7 and the separation cam 111 are in the state shown in FIG. 4, there is a gap between the development roller 40 and photosensitive drum 1.

The apparatus main assembly is provided with the separation cam 111 as a rotatable member, the position of which corresponds to the lengthwise center portion of the cartridge 7. The separation cam 111 is a means for causing the development roller 40 to separate from the photosensitive drum 1 against the pressure from the compression springs 53. The separation cam 111 is solidly attached to its shaft 80. Therefore, it rotates as the shaft 80 rotates. The separation cam 111 has a small radius portion 111*b* and a large radius portion 111*c*.

Referring to FIG. 3, the radius of the small radius portion 111*b* is such that when the development roller 40 is in contact with the photosensitive drum 1, a gap T is present between the small radius portion 111*b* and the load bearing portion 4*e*, with which the development unit 4 is provided. Referring to FIG. 4, the radius of the large diameter portion 111*c* is large enough for the separation cam 111 to come into contact with the load bearing portion 4*e* and make the development unit 4 pivot by an angle large enough to move the development 4 into the position (first separation position) in which it keeps the development roller 40 separated by a distance of L1 from the photosensitive drum 1.

Referring to FIG. 4, when the apparatus main assembly is not operating, the separation cam 111 is in a position (which hereafter will be referred to as the first separation cam position) in which its large radius portion 111*a* is in contact with the load bearing portion 4*e*. More specifically, as the separation cam 111 is rotated into the first position, the load bearing portion 4*e* is pressed by the large radius portion 111*a*. Thus, the development unit 4 is made to rotate about the connective pins 37 in the direction to separate the development roller 40 from the development roller 40. Thus, when the separation cam 111 is in the first position, the development roller 40 remains separated from the photosensitive drum 1 by a distance of L1. With the development roller 40 remaining separated from the photosensitive drum, even if the cartridge 7 is left unused for a long time in the cartridge bay 90, the elastic layer of the development roller 40 is not deformed. Therefore, it does not occur that if the cartridge 7 is left unused for a long time in the cartridge bay 90, an image is formed with non-uniform density.

As an image forming operation is started by a print signal, the separation cam 111 is moved (rotated) into a position (which hereafter will be referred to as the second separation cam position, shown in FIG. 3) in which its small radius portion opposes the load bearing portion 4*e* of the development unit 4. When the separation cam 111 is in this position, there is a gap T between the load bearing portion 4*e* and the small radius portion 111*b*, allowing the resiliency of the compression springs 53 to press the development roller 40 on the photosensitive drum 1 so that a preset amount of contact pressure is provided between the development roller 40 and photosensitive drum 1. Therefore, when the separation cam 111 is in the second separation cam position, the image forming apparatus is actually ready for image formation.

(Separating Members 50 and 51 of Process Cartridge)

Next, the mechanism for keeping the separating members 50 and 51 of the cartridge 7 engaged, or disengaging the separating members 50 and 51, will be described.

Figure 6:
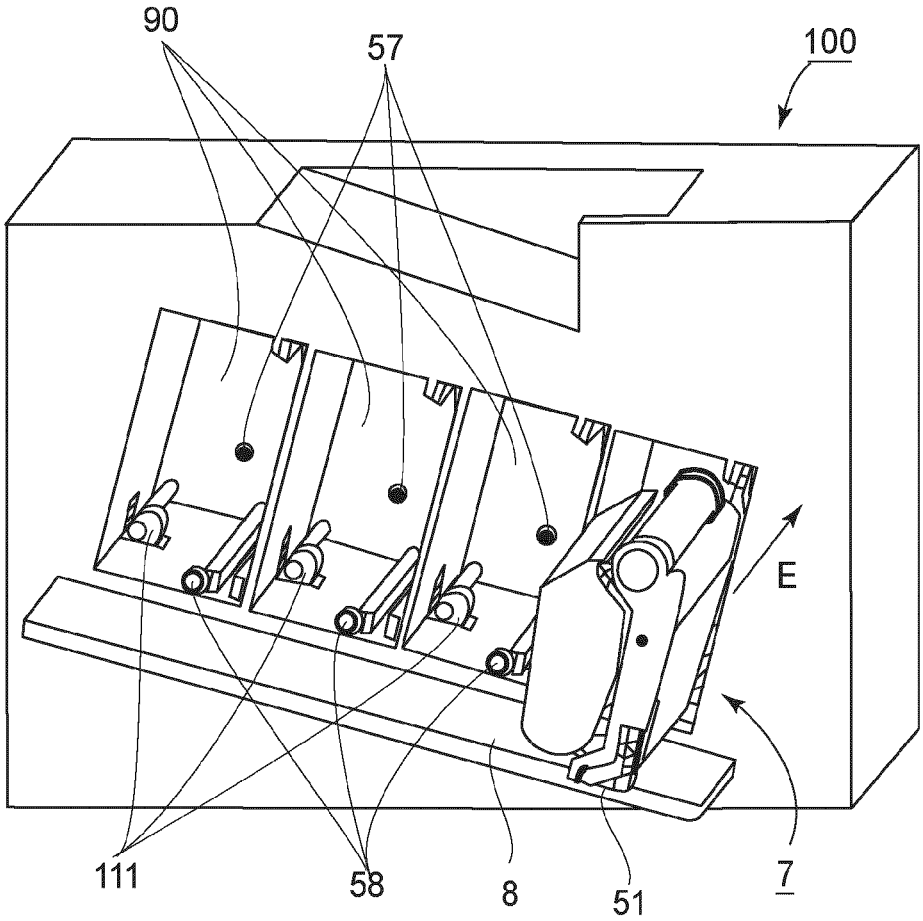
FIG. 6 is a cross-sectional view of the image forming apparatus in the first embodiment, in which one of the process cartridges is being inserted into the corresponding cartridge bay in the image forming apparatus, being ready to be mounted into the apparatus.
Figure 7:
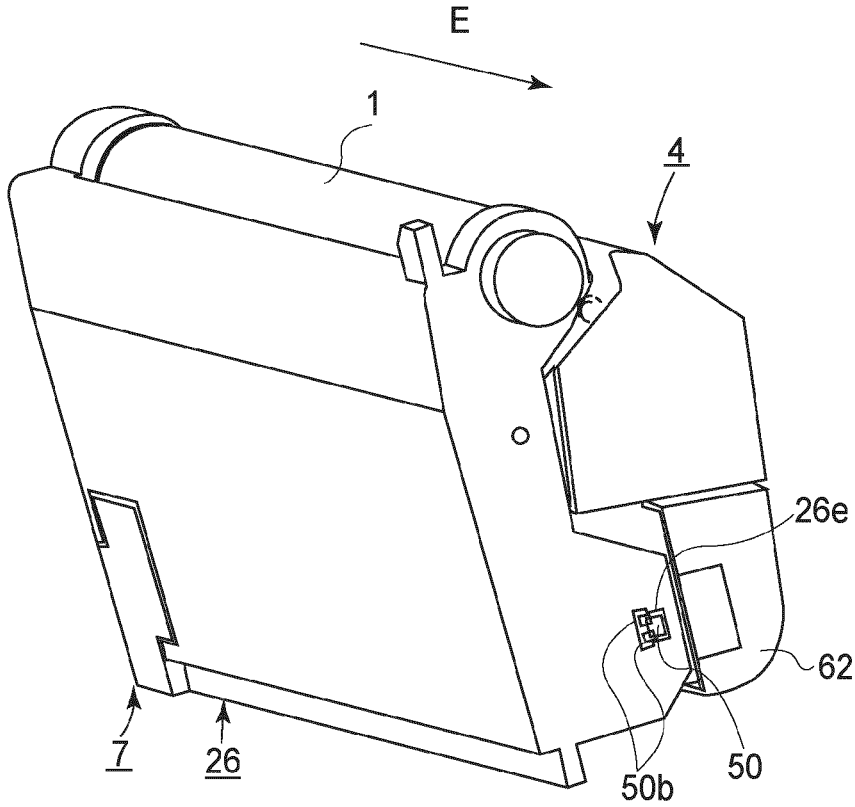
FIG. 7 is an external perspective view of the process cartridge, as seen from the downstream side in terms of the direction in which the cartridge is mounted into the main assembly of the image forming apparatus.
Figure 10:
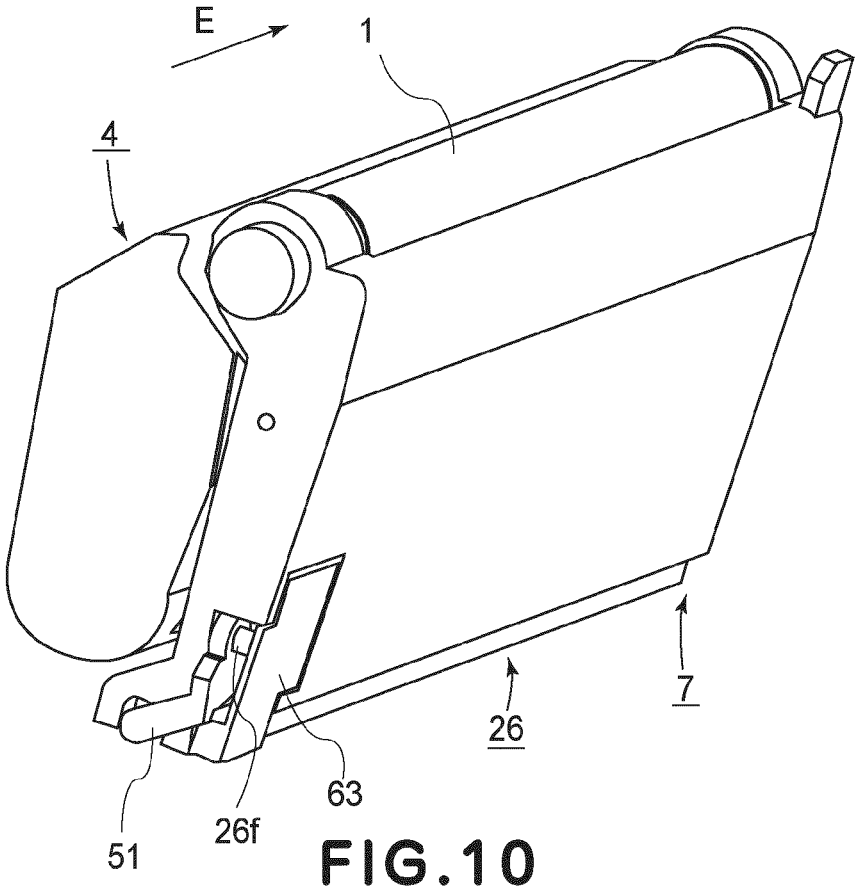
FIG. 10 is an external perspective view of the process cartridge, as seen from the upstream side, in terms of the direction in which the process cartridge is mounted into the main assembly of the image forming apparatus.

FIG. 6 is a perspective view of the apparatus main assembly, and one of the process cartridges 7 which is being mounted into the main assembly. FIGS. 7 and 10 are external perspective views of the cartridge 7, as seen from the downstream and upstream sides, respectively, in terms of the cartridge mounting direction.

The cartridge 7 has a pair of separating members 50 (FIG. 7) and 51 (FIG. 10), which are at the downstream end (rear end) and upstream end (front end), respectively, in terms of the cartridge mounting direction (direction indicated by arrow mark E in FIG. 5). That is, the separating members 50 and 51 are at the lengthwise ends of the process cartridge 7, one for one. On the other hand, each of the cartridge bays of the apparatus main assembly is provided with a pair of disengaging portions 57 and 58 for disengaging the separating members 50 and 51, respectively.

(Structure of Mechanism for Keeping Engaged, or Disengaging, Separating Member 50)

Figure 8:
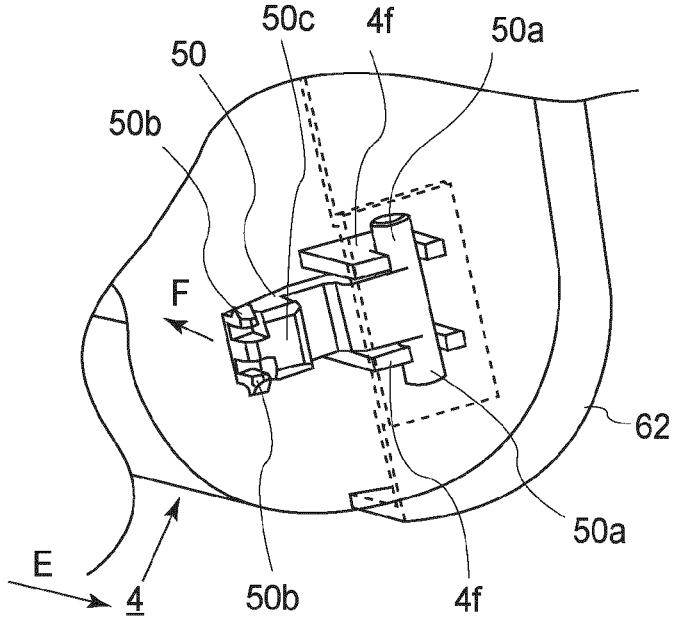
FIG. 8 is a perspective view of the separating member of the process cartridge, which is at the downstream end in terms of the direction in which the process cartridge is mounted into the main assembly of the image forming apparatus.
Figure 9:
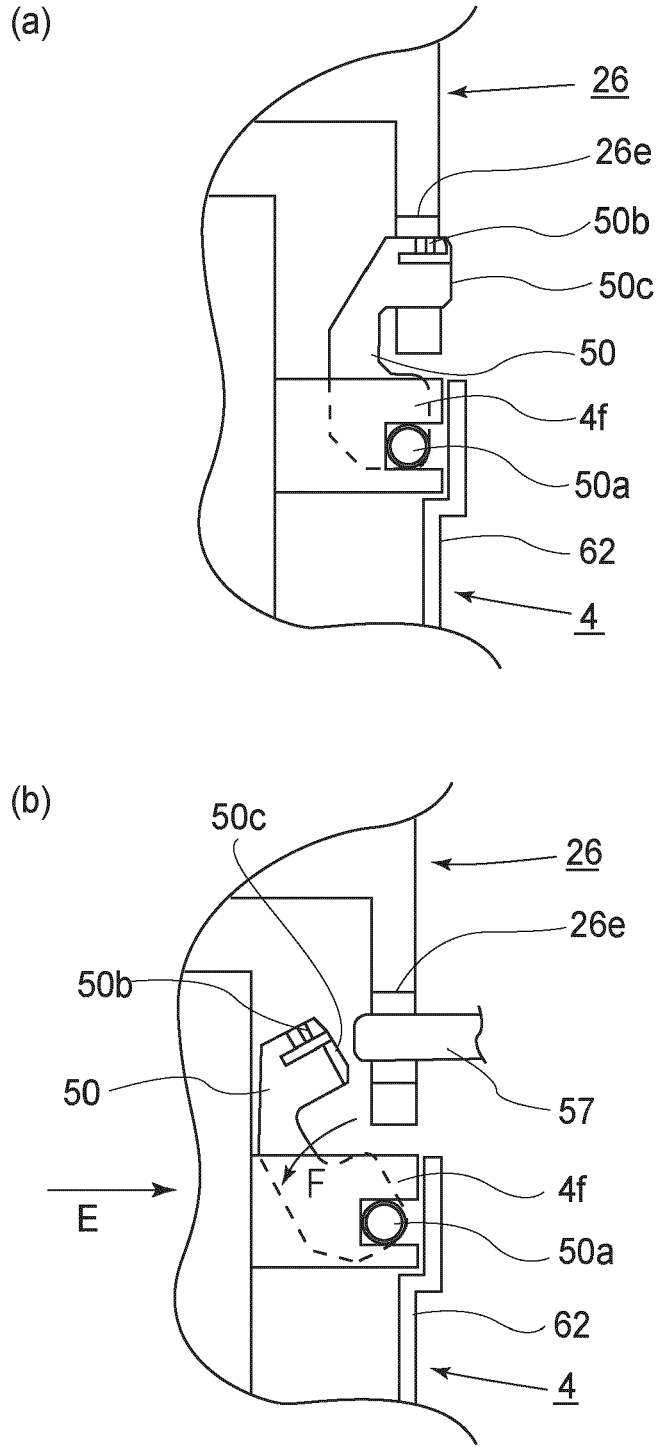
FIGS. 9(*a*) and 9(*b*) are side views of the separating member of the process cartridge, which is at the downstream end, in terms of the direction in which the process cartridge is mounted into the main assembly of the image forming apparatus, with FIG. 9(*a*) showing the engaged separating member, and FIG. 9(*b*) showing the disengaged separating member.

First, the structure of the mechanism for keeping engaged, or disengaging the separating member 50 will be described. FIG. 8 is a perspective view of the separating member 50 held by the development unit 4, showing how the separating member 50 is held by the development unit 4. FIGS. 9(*a*) and 9(*b*) are side views of the separating member 50, and the separating member engaging portion (hole) of the photosensitive member unit 26. FIG. 9(*a*) shows the separation member 50 and separating member engaging portion of the photosensitive member unit 26, in engagement, whereas FIG. 9(*b*) shows them separated from each other. For the purpose of showing the portion of the separating member, which is on the inward side of a cover 62 for the separating member 50, the cover 62 is outlined with a broken line.

Referring to FIGS. 7-9, the separating member 50 is supported by the supporting portion 4*f* of the development unit 4. More specifically, the shaft 50*a* of the separating member 50 is rotatably supported by the supporting portion 4*f* of the development unit 4, and is prevented from disengaging from the supporting portion 4*f*, by the cover 62.

When the separating member 50 is in the state shown in FIG. 9(*a*), the engaging portion 50*b* of the separating member 50 is in the hole 26*e* of the photosensitive member unit 26 (this position of separating member 50, shown in FIG. 9(*a*), will be referred to as the separation position). That is, when the separating member 50 is in the separation position, the development unit 4 is in its second position, in which it keeps the development roller 40 separated from the photosensitive drum 1.

Prior to the mounting of the cartridge 7 into the apparatus main assembly, the separating member 50 is in the state shown in FIG. 9(*a*). Then, as the cartridge 7 is mounted into the apparatus main assembly, the separating member 50 is disengaged as shown in FIG. 9(*b*).

More specifically, as the cartridge 7 is inserted into the cartridge bay 90, in the direction indicated by an arrow mark E, with the separating member 50 being in the above described separation position, the inward movement of the cartridge 7 causes the engaging portion 50*c* of the separating member 50 to come into contact with the separating member disengaging portion 57 of the apparatus main assembly. Then, as the cartridge 7 is inserted further into the cartridge bay 90, the engaging portion 50*b* of the separating member 50 is pushed by the separating member disengaging portion 57, being thereby moved out of the hole 26*e*. Thus, the separating member 50 is made to rotate about the shaft 50*a* in the direction indicated by an arrow mark F, by the separating member disengaging portion 57. In other words, as the cartridge 7 is inserted into the apparatus main assembly, the separating member 50 comes into contact with the separating member disengaging portion 57 of the apparatus main assembly, and then, is moved out of the abovementioned separation position; the engaging portion 50*b* is moved out of the hole 26*e*. As a result, the development roller 40 comes into contact with the photosensitive drum 1. In other words, as the cartridge 7 is mounted into the cartridge bay 90, the separating members 50 and 51 are moved out of the abovementioned separation positions, and then are moved into their retracted positions, retracted from their separation positions.

As the development unit 4 is freed from the restraint imposed by the separating member 50, it is ready to be pivoted by the force generated by the compression springs 53, into the second position, that is, the position in which it keeps the development roller 40 in contact with the photosensitive drum 1.

(Structure of Mechanism for Keeping Engaged, or Separating, Separating Member 51)

Next, the structure of the mechanism for keeping engaged, or separating, the separating member 51 will be described.

FIG. 10 is an external perspective view of the cartridge 7 as seen from the upstream side in terms of the cartridge mounting direction. The separating member 51 is rotatably supported by the shaft 26*f* of the photosensitive member unit 26, and is prevented from disengaging from the shaft 26*f*, by the cover 63.

Figure 11:
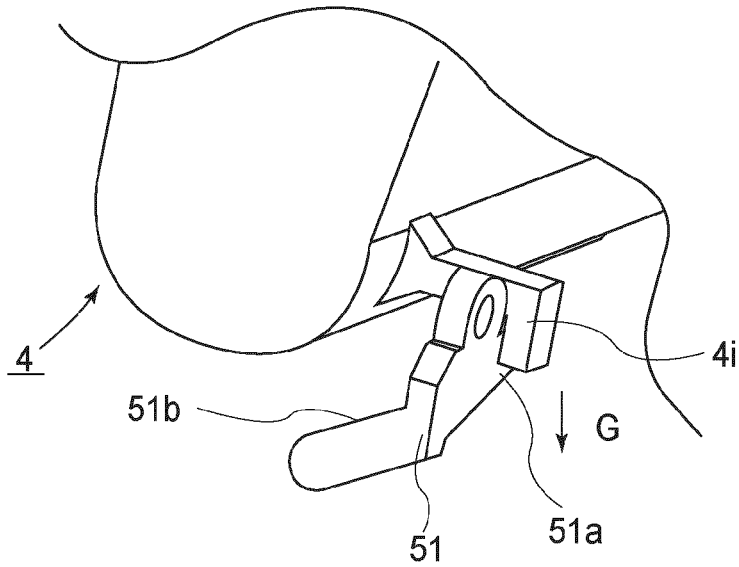
FIG. 11 is a perspective view of the separating member on the upstream side in terms of the direction in which the process cartridge is mounted into the main assembly of the image forming apparatus.

FIG. 11 is a perspective view of the separating member 51, and the portion of the development unit 4 which is in engagement with the separating member 51. FIG. 11 does not show the photosensitive member unit 26. Referring to FIG. 11, when the separating member 51 is kept in the position in which it keeps the development roller 40 separated from the photosensitive drum 1, the hook-shaped portion 4*i* of the development unit 4 is latched with the regulating portion 51*a* of the separating member 51.

Figure 12:
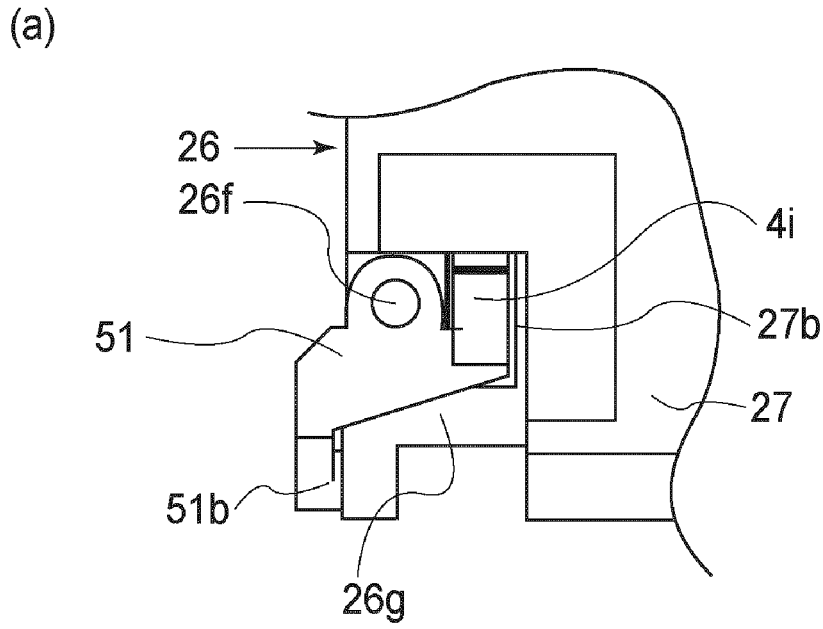
FIGS. 12(*a*) and 12(*b*) are side views of the separating member on the upstream side, with FIGS. 12(*a*) showing the engaged separating member, and FIG. 12(*b*) showing the disengaged separating member.
Figure 12:
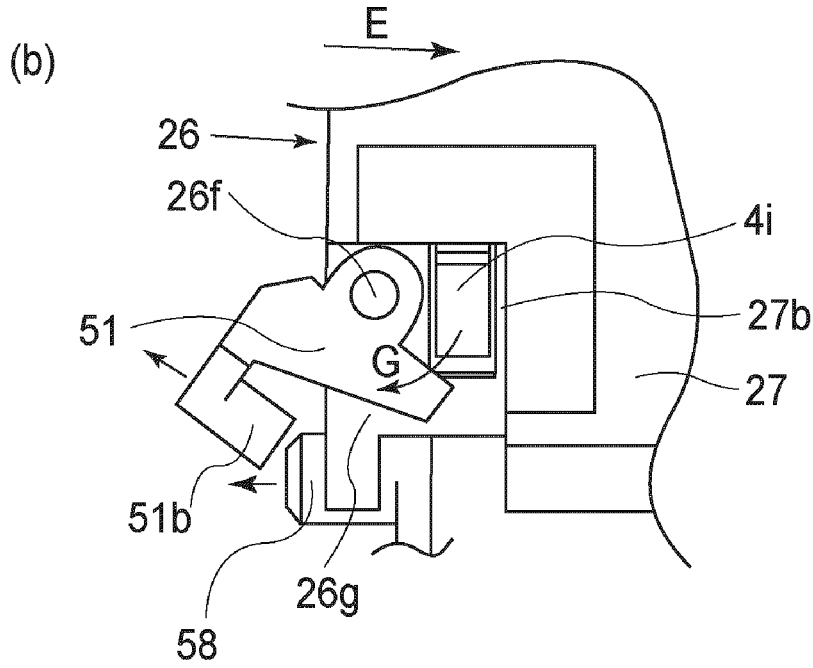

FIGS. 12(*a*) and 12(*b*) are side views of the separating member 51 as seen from the direction of cover 63. In order to show the portion of the separating member 51, which is on the inward side of the cover 63, the cover 63 is not shown in FIG. 12. FIG. 12(*a*) shows the separating member 51 when it is in the separation position, and FIG. 12(*b*) shows the separating member 51 when it is in its retreat.

When the separating member 51 is in engagement with the hook-shaped portion 4*i* of the development unit 4 as shown in FIG. 12(*a*), the end portion of the hook-shaped portion 4*i* of the development unit 4 is in the cleaning means frame 27, through the hole 27*b* of the cleaning means frame 27, and the regulating portion 51*a* of the separating member 51 is sandwiched by the end portion of the hook-shaped portion 4*i* of the development unit 4, and the wall 26*g* of the photosensitive member unit 26. Thus, the development unit 4 is retained in its second position in which it keeps development roller 40 separated from the photosensitive drum 1.

As the cartridge 7 is mounted into the apparatus main assembly as shown in FIG. 12(*b*), the engaging portion 51*b* of the separating member 51 comes into contact with the separating member disengaging portion 58 of the apparatus main assembly. Then, as the cartridge 7 is inserted further into the apparatus main assembly, the separating member 51 is rotated by the separating member disengaging portion 58 in the direction indicated by an arrow mark G, and therefore, the regulating portion 51*a* of the separating member 51 rotates about the shaft 26*f* in the direction indicated by the arrow mark G, moving, therefore, away from the hook-shaped portion 4*i*. As a result, the hook-shaped portion 4*i* loses its support; in other words, the development unit 4 is freed from the separating member 51.

As the development unit 4 is freed from the separating member 51, it is allowed to be rotated by the force generated by the compression springs 53, into the position (contact position) in which it keeps the development roller 40 in contact with the photosensitive drum 1.

(Mounting of Process Cartridge 7 into Apparatus Main Assembly 100 (Cartridge Bay 90))

Next, the operation for mounting the cartridge 7 into the apparatus main assembly will be described.

Figure 13:
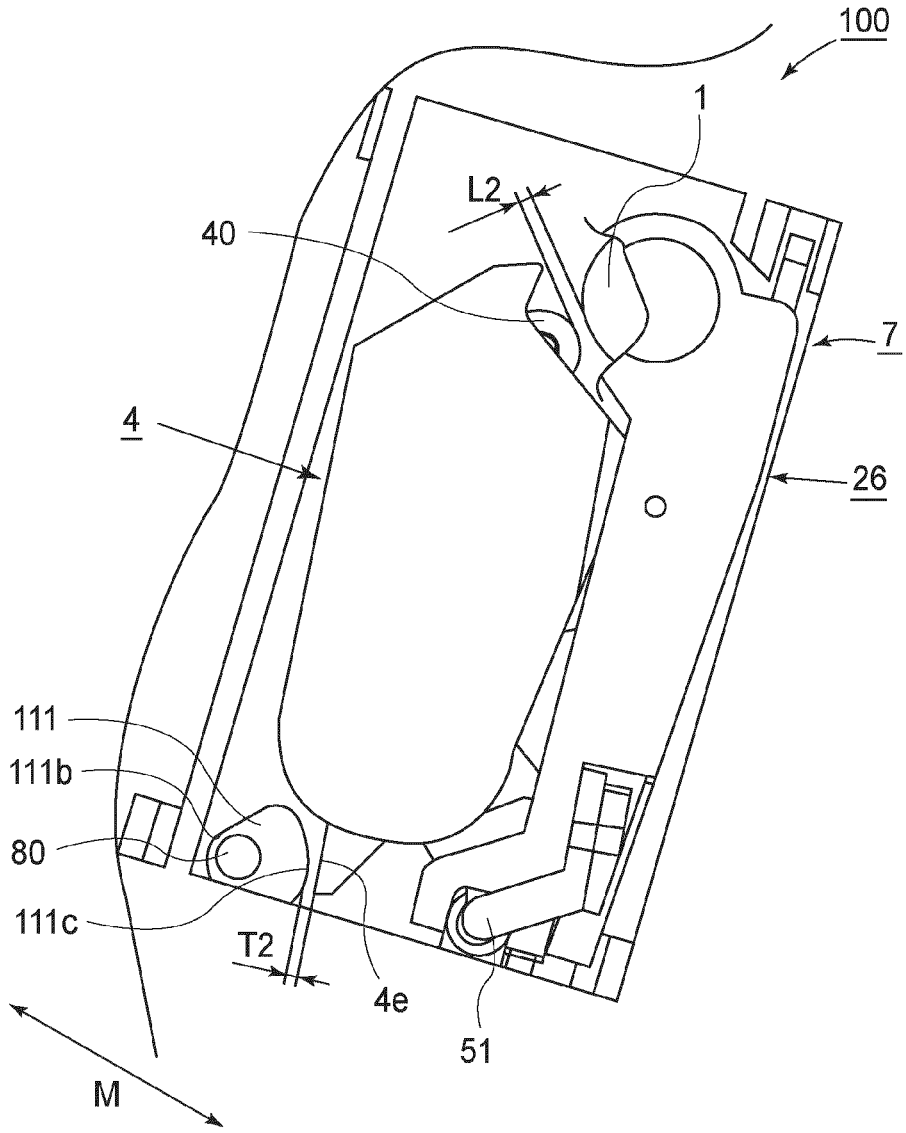
FIG. 13 is a front view of one of the process cartridge bays of the image forming apparatus, and the process cartridge which is being mounted into the bay.

FIG. 13 is a front view of one of the cartridge bays 90 of the apparatus main assembly, and the cartridge 7 which is being mounted into the cartridge bay 90. When the cartridge bay 90 and cartridge 7 are in the state shown in FIG. 13, that is, in the state in which the mounting of the cartridge 7 has not been completed, the separating members 50 and 51 are yet to be disengaged. Thus, there is a gap L2 (distance), which is provided by the separating members 50 and 51, between the development roller 40 and photosensitive drum 1. This distance L2 is greater than the distance L1 provided by the separation cam 111 (L1<L2). Therefore, while the cartridge 7 is mounted into the apparatus main assembly 100, there is a gap T2 between the load bearing portion 4*e* of the development unit 4 and the large radius portion 111*c* of the separation cam 111.

Figure 14:
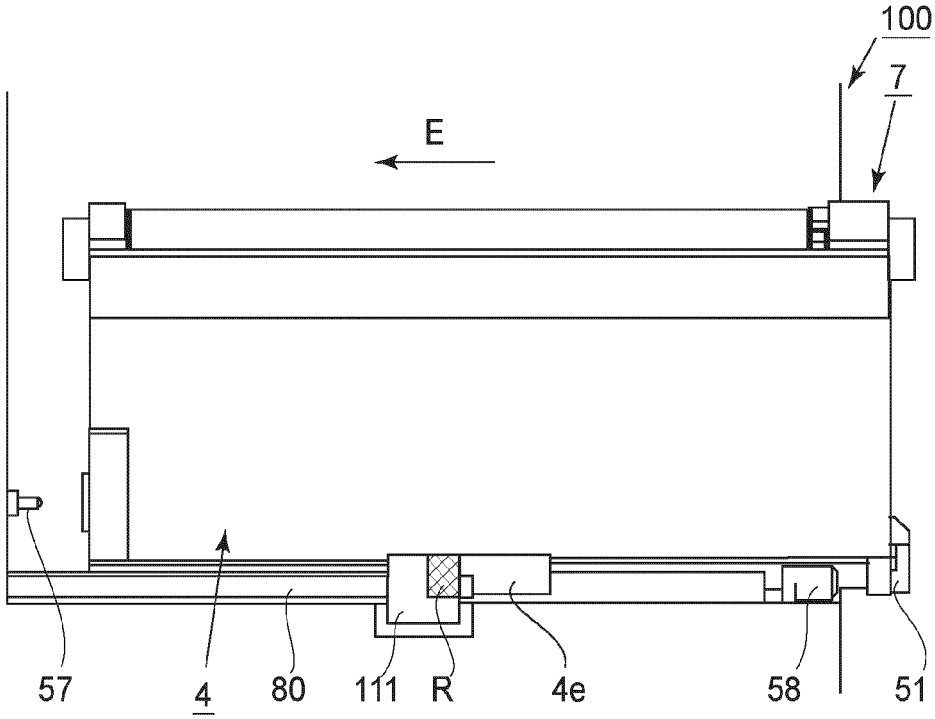
FIG. 14 is a sectional view of one of the process cartridge bays of the image forming apparatus, and the process cartridge which is being mounted into the bay.
Figure 15:
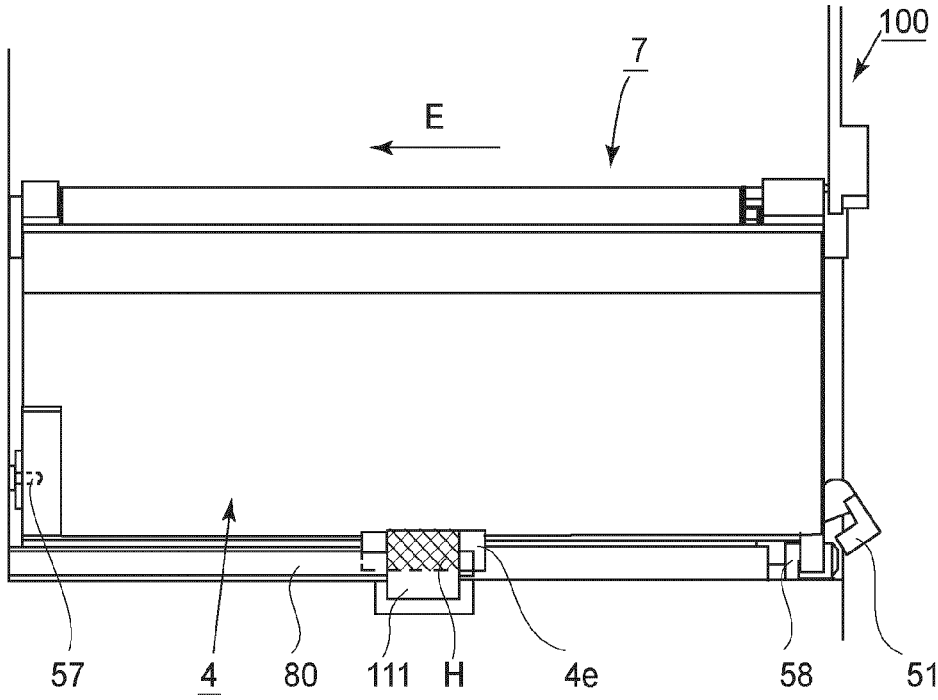
FIG. 15 is a sectional view of one of the process cartridge bays of the image forming apparatus, and the process cartridge which has just been completely mounted into the bay.

FIG. 14 is a side view (as seen from development unit side) of one of the cartridge bays 90 of the apparatus main assembly 100, and the cartridge 7 which is being mounted into the cartridge bay 90. FIG. 15 is a side view (as seen from development unit side) of one of the cartridge bays 90 of the apparatus main assembly 100, and the cartridge 7 which has just been completely mounted into the cartridge bay 90.

As the cartridge 7 is inserted into the cartridge bay 90 far enough to reach the position shown in FIG. 14, the load bearing portion 4*e* of the development unit 4 overlaps with the separation cam 111 (cross-hatched portion R in FIG. 14). As described above, there is the gap T2 between the load bearing portion 4*e* and the functional surface of the separation cam 111 (large radius portion 111*c*). Therefore, the cartridge 7 is not subjected to an additional amount of load; the amount of force necessary to mount the cartridge 7 into the cartridge bay 90 does not increase.

Then, as the cartridge 7 is inserted deep enough to reach the position shown in FIG. 15, the separating members 50 and 51 come into contact with the separating member disengaging portions 57 and 58 of the apparatus main assembly. Then, as the cartridge 7 is inserted further, the separating members 50 and 51 are disengaged by the separating member disengaging portions 57 and 58, respectively. While the separating members 50 and 51 are disengaged, the load bearing portion 4*e* and the functional surface of the separation cam 111 (large radius portion 111*c*) remain opposed to each other, without contacting with each other (with the presence of gap T2). In other words, before the separating members 50 and 51 are disengaged, at least a part of the load bearing portion 4*e* overlaps with at least a part of the separation cam 111, in terms of the direction perpendicular to the cartridge mounting direction (indicated by arrow mark E) (the direction in which the load bearing portion 4*e* is moved to be placed in contact with, or separated from, separation cam 111 (direction indicated by arrow mark M)). In other words, as the cartridge 7 is inserted deep enough into the cartridge bay 90 to make it possible for the load bearing portion 4*e* to be placed in contact with the large radius portion 111*c*, the large radius portion 111*c* opposes the load bearing portion 4*e* without coming in contact with the load bearing portion 4*e*. Here, the direction in which the load bearing portion 4*e* is moved to be placed in contact with, or to be separated from, the separation cam 111 is the same direction in which the load bearing portion 4*e* is moved when the development roller 40 is placed in contact with, or separated from, the photosensitive drum 1. Further, it is after the cartridge 7 is inserted far enough to make it possible for the load bearing portion 4*e* to be placed in contact with the large radius portion 111*c* that the separating member disengaging portions 57 and 58 of the apparatus main assembly 100 come into contact with the separating members 50 and 51 to move the separating members 50 and 51 out of the abovementioned separation positions, respectively.

As the separating members 50 and 51 are moved out of their separation positions, the load bearing portion 4*e* of the development unit 4 comes into contact with the large radius portion 111*c* of the separation cam 111, in the cross-hatched portion H in FIG. 15, keeping the development roller 40 separated from the photosensitive drum 1, in the apparatus main assembly. That is, as the separating member disengaging portions 57 and 58 move the separating members 50 and 51 out of the abovementioned separation position, by coming into contact with the separating members 50 and 51, the load bearing portion 4*e* comes into contact with the large radius portion 111*c*, keeping thereby the development roller 40 separated from the photosensitive drum 1.

As described above, in this embodiment, while the cartridge 7 is mounted into the apparatus main assembly, the development roller 40 is prevented from coming into contact with the photosensitive drum 1. Therefore, it does not occur that the shock, which occurs as the development roller 40 comes into contact with the photosensitive drum 1, is transmitted to the hand of a user. In other words, the cartridge 7 in this embodiment is superior in operability to a process cartridge in accordance with the prior art. Also in this embodiment, when the cartridge 7 is mounted into the apparatus main assembly (cartridge bay 90), the load to which a process cartridge in accordance with the prior art is subjected when it is mounted into the main assembly of an image forming apparatus in accordance with the prior art is not present. That is, it is only when the separating members 50 and 51 are disengaged that the cartridge 7 in this embodiment is subjected to a certain amount of load. Therefore, the amount of force nesessary to mount the cartridge 7 into the apparatus main assembly in this embodiment is significantly smaller than a process cartridge in accordance with the prior art.

Embodiment 2

Figure 16:
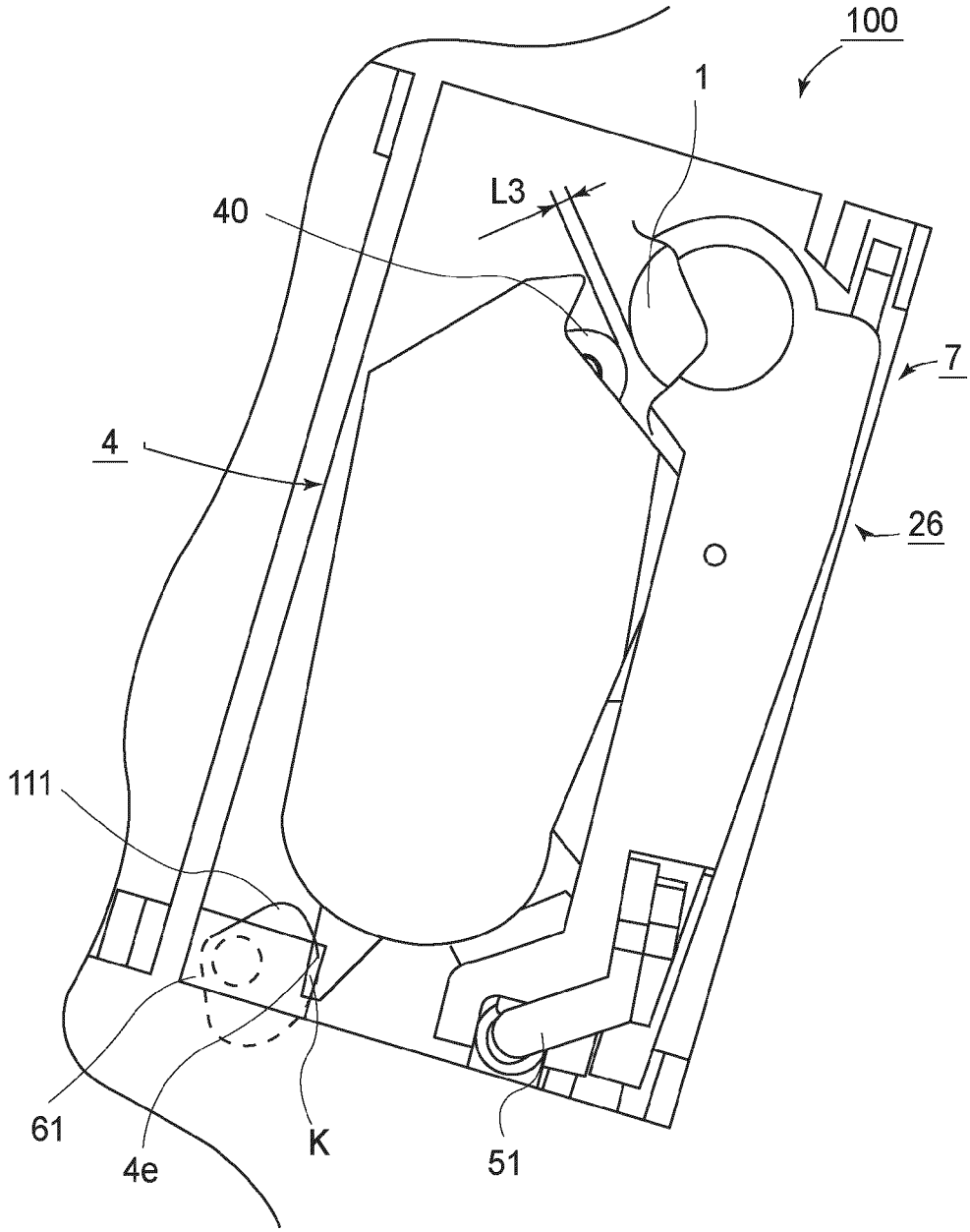
FIG. 16 is a front view of one of the process cartridge bays of the image forming apparatus in the second embodiment of the present invention, and the process cartridge in the second embodiment, which is being mounted into the bay.
Figure 17:
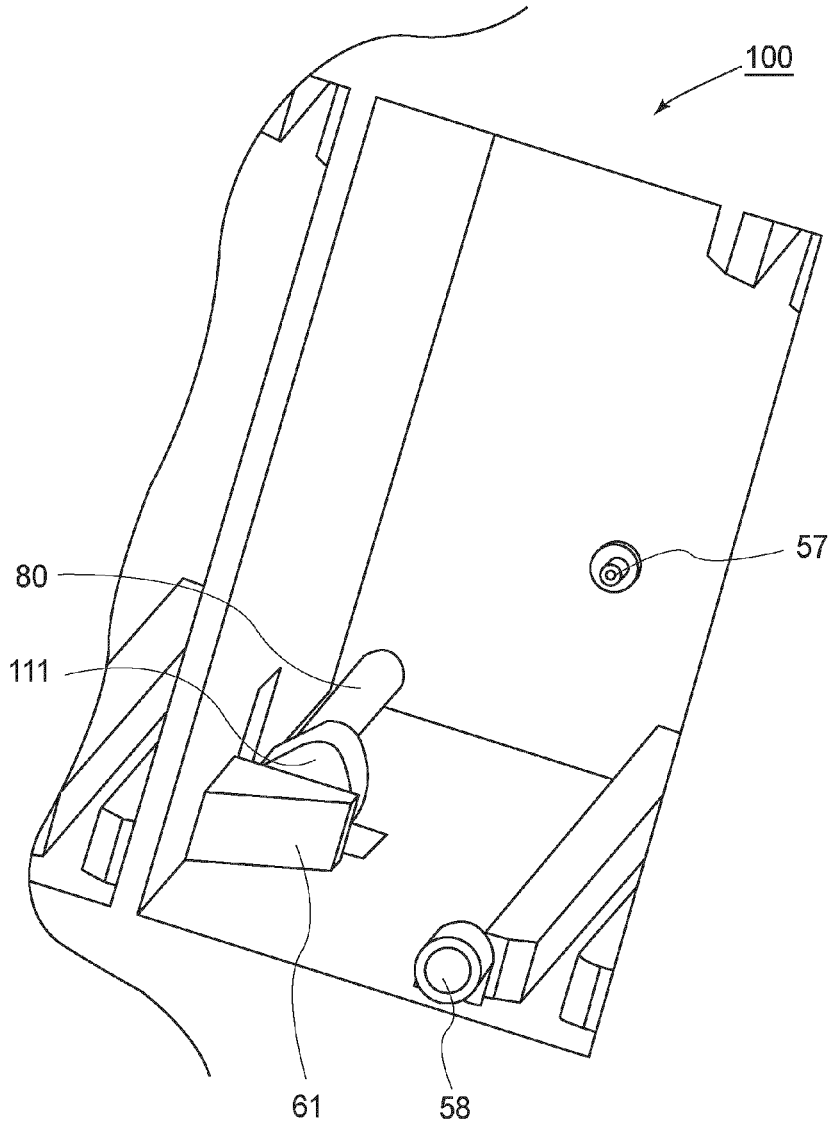
FIG. 17 is a perspective view of one of the process cartridge bays of the main assembly of the image forming apparatus in the second embodiment, as seen from the opening side of the bay.

Next, the process cartridge and image forming apparatus in the second embodiment of the present invention will be described with reference to the appended drawings. FIG. 16 is a front view of one of the process cartridge bays 90 of the main assembly 100 of the image forming apparatus in this embodiment, and the process cartridge 7 in the cartridge bay 90. FIG. 17 is a perspective view of one of the process cartridge bays 90 of the apparatus main assembly 100, as seen from the front side of the apparatus main assembly 100. The portions of the apparatus main assembly in this embodiment, the descriptions of which are duplicates of those of the counterparts in the first embodiment, will be given the same reference symbols as those given for the description of the first embodiment, and will not be described.

Referring to FIGS. 16 and 17, the cartridge 7 and image forming apparatus in this embodiment are the same in structure as those in the first embodiment, except that each of the process cartridge bays 90 in this embodiment is provided with a portion having a slanted surface 61, which is on the upstream side of the separation cam 111 in terms of the cartridge mounting direction.

As the cartridge 7 is mounted into the apparatus main assembly in the direction indicated by an arrow mark E, the slanted surface 61 comes into contact with the load bearing portion 4*e* and reactively pushes the load bearing portion 4*e*. As a result, the development unit 4 is moved into the second separation position. The portion having the slanted surface 61 is shaped so that the slanted surface 61 is slanted reward, and also, so that as the cartridge 7 is mounted into the apparatus main assembly, the slanted surface 61 makes the load bearing portion 4*e* retreat by the same distance as, or a greater distance than the large radius portion 111*c*.

When the cartridge 7 is in the position shown in FIG. 16, the operation for mounting the cartridge 7 has not been completed, and the separating members 50 and 51 have not been disengaged. Thus, a gap L3 (distance) between the development roller 40 and photosensitive drum 1 shown in FIG. 16, is the gap provided by the separating members 50 and 51. This gap L3 is smaller than the gap L1 provided between the development roller 40 and photosensitive drum 1 by the separation cam 111 (L1>L3). Thus, during the operation for mounting the cartridge 7, the load bearing portion 4*e* and the large radius portion 111*c* overlap with each other across the area K in FIG. 16. Therefore, before the completion of the operation for mounting the cartridge 7, the load bearing portion 4*e* of the development unit 4 must be moved in the rightward direction in FIG. 15, by a distance equivalent to the size of the cross-hatched portion in FIG. 15, to be placed in contact with the functional surface of the separation cam 111.

Referring to FIG. 17, in this embodiment, however, the cartridge bay 90 is provided with the portion having the slanted surface 61, which is on the upstream side of the separation cam 111 in terms of the cartridge mounting direction. Therefore, as the cartridge 7 is inserted into the cartridge bay 90, the load bearing portion 4*e* comes into contact with the slanted surface 61. Thus, as the cartridge 7 is inserted further, it is smoothly (easily) displaced rightward in the drawing, being enabled to smoothly come into contact with the functional surface of the large radius portion 111*c*.

Incidentally, in this embodiment, the apparatus main assembly is provided with the slanted surface 61. However, it may be the cartridge 7 that is provided with the slanted surface 61. In the case where the cartridge 7 is provided with the slanted surface 61, the slanted surface 61 must be positioned on the downstream side of the load bearing portion 4*e* in terms of the cartridge mounting direction.

Next, the operation for mounting the process cartridge will be described.

(Operation for Mounting of Process Cartridge)

Figure 18:
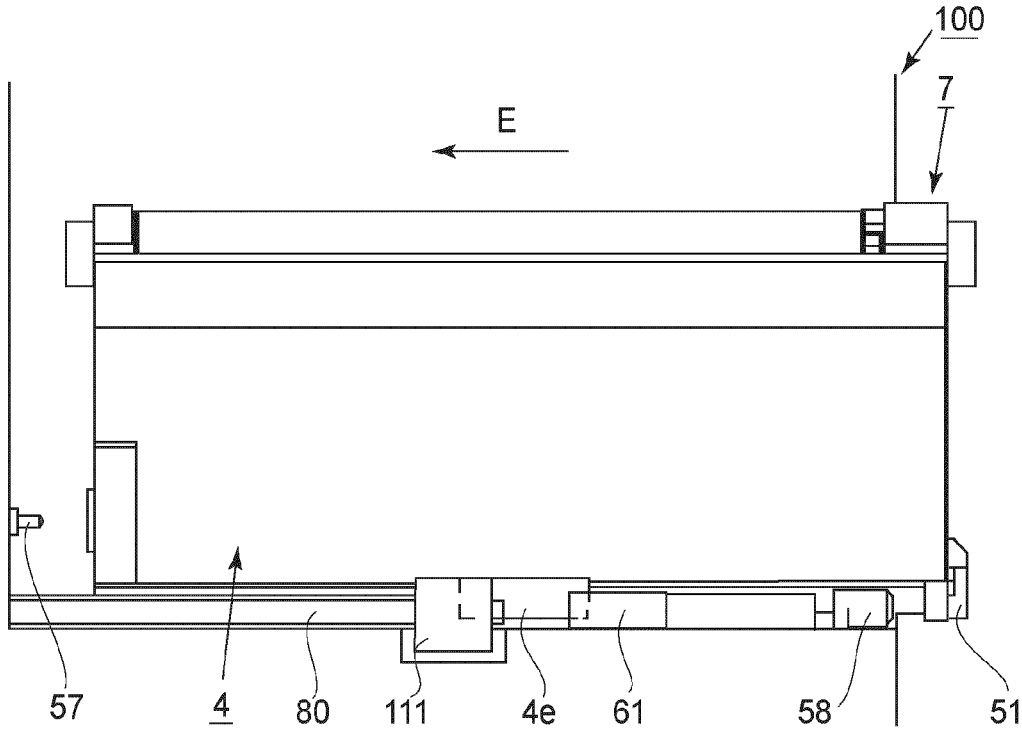
FIG. 18 is a sectional view of one of the process cartridge bays of the image forming apparatus in the second embodiment, and the process cartridge in the second embodiment, which is being mounted into the bay.
Figure 19:
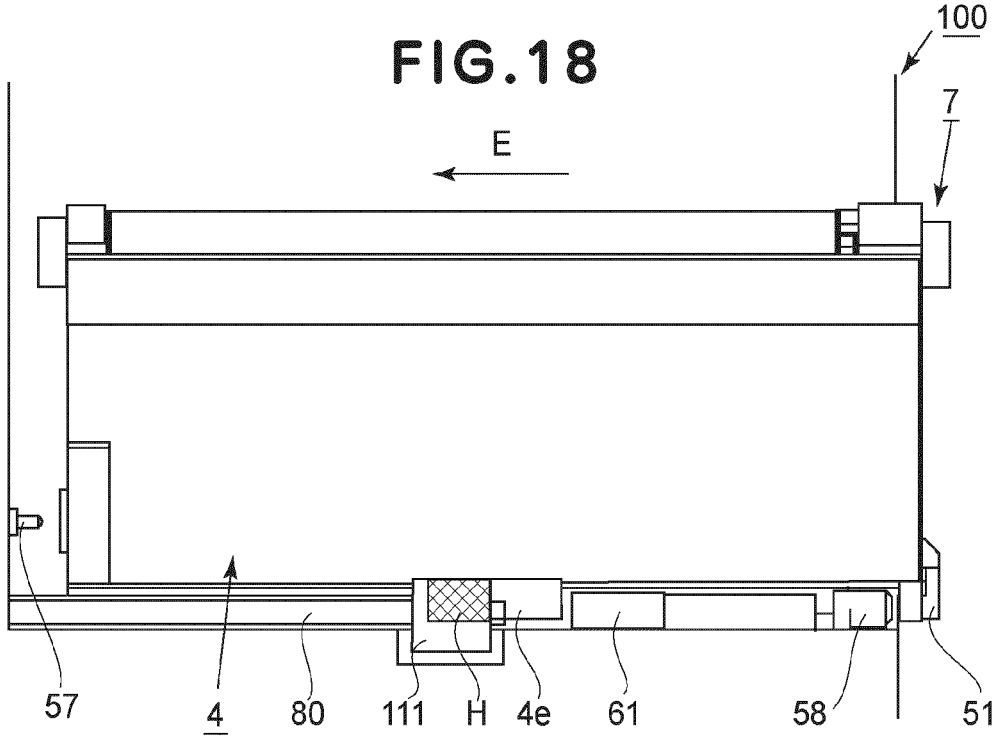
FIG. 19 is a sectional view of one of the process cartridge bays of the image forming apparatus in the second embodiment, and the process cartridge in the second embodiment, which is being mounted into the bay.
Figure 20:
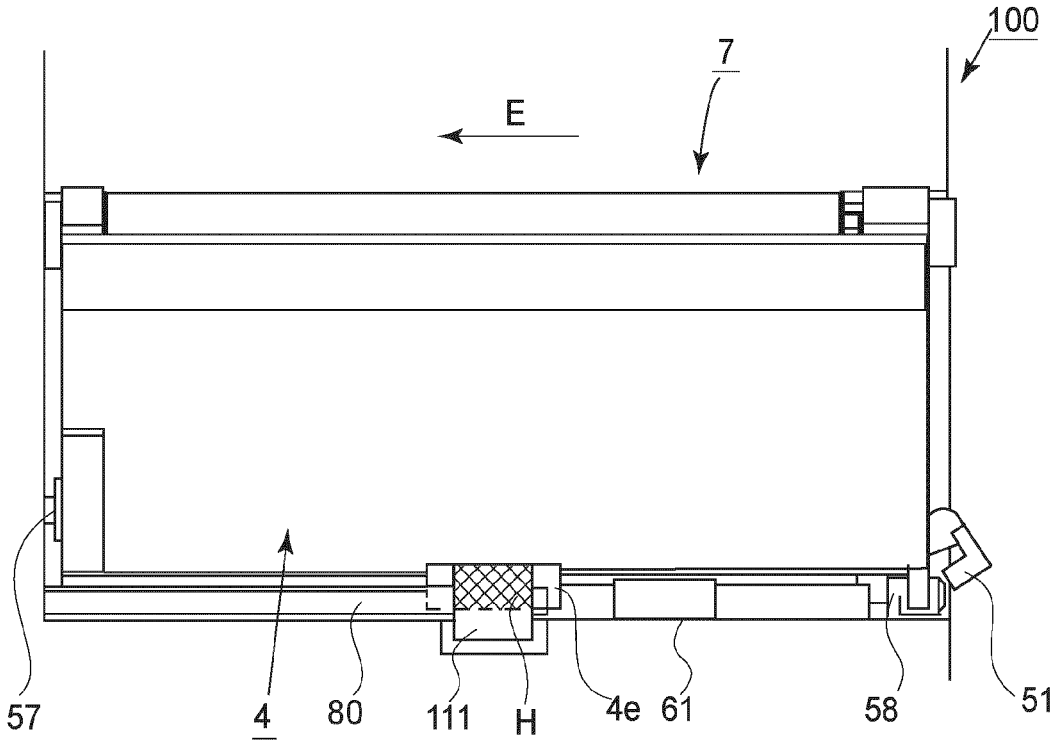
FIG. 20 is a sectional view of one of the process cartridge bays of the image forming apparatus in the second embodiment, and the process cartridge in the second embodiment, which has just been completely mounted into the bay.

FIGS. 18 and 19 are side views (as seen from development unit side) of one of the cartridge bays 90 of the apparatus main assembly, and the cartridge 7, which is being mounted into the cartridge bay 90. FIG. 20 is a side view (as seen from development unit side) of one of the cartridge bays 90 of the apparatus main assembly, and the cartridge 7, which has just been completely mounted into the cartridge bay 90. First, the cartridge 7 is inserted into the cartridge bay 90 in the cartridge mounting direction (indicated by arrow mark E). As the cartridge 7 reaches the position shown in FIG. 18, the load bearing portion 4*e* begins to slide on the slanted surface 61. Then, as the cartridge 7 is inserted further, it slides onto the separation cam 111.

Thereafter, as the cartridge 7 is inserted deeper so that it moves into the position shown in FIG. 19, the force bearing portion 4*e* becomes separated from the slanted surface 61, and comes into contact with only the separation cam 111 (large radius portion 111*c*), only in the cross-hatched area H. The cartridge 7 is to be inserted further thereafter. As the cartridge 7 is inserted deep enough for the cartridge 7 to be moved into the position shown in FIG. 20, the separating members 50 and 51 come into contact with the separating member disengaging portions 57 and 58 of the apparatus main assembly, and are prevented by the separating member disengaging portions 57 and 58 from moving further into the cartridge bay 90. Thus, as the cartridge 7 is moved further into the apparatus main assembly (cartridge bay 90), the separating members 50 and 51 are disengaged (separating members 50 and 51 are made to retreat from the abovementioned separation position). That is, when the separating members 50 and 51 begin to be disengaged, the force bearing portion 4*e* and the separation cam 111 (large radius portion 111*c*) are opposing each other, being ready to be placed in contact with each other. In other words, in terms of the direction perpendicular to the cartridge mounting direction (in terms of the direction indicated by arrow mark M shown in FIG. 13) in which the force bearing portion 4*e* is moved to be placed in contact with, or separated from, the separation cam 111, at least a part of the force bearing portion 4*e* overlaps with a part of the separation cam 111, before the separating members 50 and 51 are disengaged. Here, the direction in which the load bearing portion 4*e* is moved to be placed in contact with, or separated from, the functional surface of the separation cam 111 is the same as the direction in which the load bearing portion 4*e* moved to place the development roller 40 in contact with the photosensitive drum 1, or separate the development roller 40 from the photosensitive member unit 26.

As described above, in this embodiment, during the operation for mounting the cartridge 7, the development roller 40 is prevented from coming into contact with the photosensitive drum 1. Therefore, in the case of the process cartridge 7 and image forming apparatus in this embodiment, the shock which occurs when a process cartridge in accordance with the prior art is mounted, and which is attributable to the abrupt contact between the development roller 40 and photosensitive drum 1, does not occur. Therefore, in the case of the process cartridge and the image forming apparatus in this embodiment, a shock is not transmitted to the hand of a user during the operation for mounting the process cartridge. In other words, the process cartridge and image forming apparatus in this embodiment are superior in operability to a process cartridge and an image forming apparatus, which are in accordance with the prior art.

Further, in this embodiment, a part of the force necessary to mount the process cartridge 7 into the apparatus main assembly (cartridge bay 90) is the load to which the load bearing surface 4*e* is subjected as it made to slide on the slanted surface 61. In this embodiment, however, the portion having the slanted surface 61 is shaped so that the slanted surface 61 is long enough (in terms of cartridge mounting direction) for the slanted surface 61 to displace the load bearing surface 4*e* only very gradually. Therefore, as the cartridge 7 is inserted into the apparatus main assembly (cartridge bay 90), the amount of force necessary for mounting the cartridge 7 increases only very gradually.

Also in this embodiment, as the cartridge 7 is inserted into the apparatus main assembly (cartridge bay 90), the gap provided between the development roller 40 and photosensitive drum 1 by the separation members 50 and 51 is increased by the slanted surface 61 of the apparatus main assembly 100. Thus, before the separating members 50 and 51 are disengaged toward the end of the operation for mounting the cartridge 7, the load to which the engaging portion of the separating member 50 and the engaging portion of the separating member 51, are subjected up to when the gap between the development roller 40 and photosensitive drum 1 is increased by the slanted surface 61, are eliminated. Therefore, in this embodiment, the amount of force necessary to disengage the separating members 50 and 51 toward the end of the operation for mounting the cartridge 7 is virtually nil.

Embodiment 3

Next, the process cartridge and the image forming apparatus in the third embodiment of the present invention will be described with reference to the appended drawings. The portions of the apparatus main assembly 100 in this embodiment, the descriptions of which are duplicates of those of the counterparts in the first embodiment, will be given the same referential symbols as those given for the description of the first embodiment, and will not be described.

Referring to FIGS. 21-24, the cartridge 7 and the image forming apparatus in this embodiment are the same in structure as those in the first embodiment, except that the cartridge 7 in this embodiment is provided with a protective cover 60 (protective member), which functions as a separating member, instead of the separating member 51.

That is, both ends of the cartridge 7 (in terms of cartridge mounting direction) are provided with a protective cover 60 for the photosensitive drum 1. The protective cover 60 on the downstream side is utilized as the separating member (50), and the protective cover 60 on the upstream side is utilized as the separating member (51). Next, the protective cover 60 for the photosensitive drum 1 will be described.

(Protective Cover 60)

The protective cover 60 is a component formed independently from the cartridge 7. It is attached to the cartridge 7 to protect the photosensitive drum 1.

Figure 21:
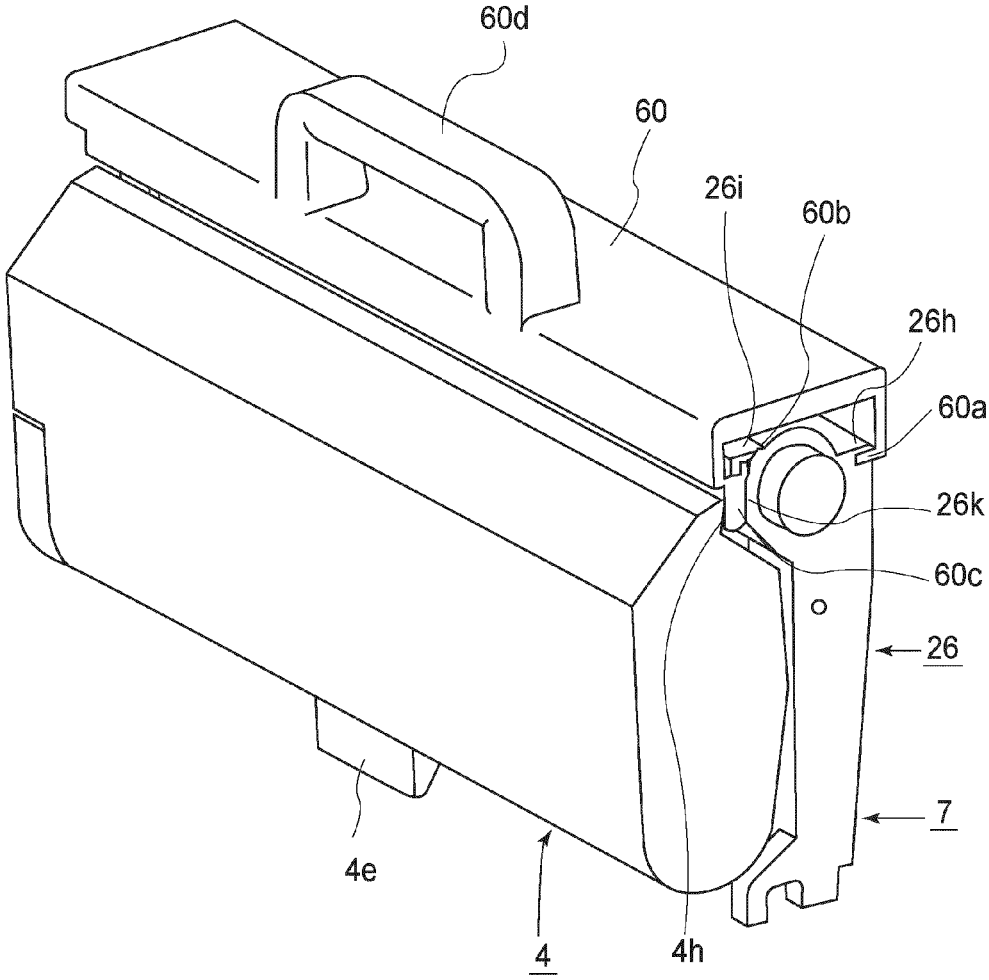
FIG. 21 is an external perspective view of the process cartridge, and its protective cover, in the third embodiment of the present invention.

FIG. 21 is an external perspective view of the cartridge 7 with the protective cover 60. As will be evident from FIG. 21, the protective cover 60 has a pair of ribs 60*a* and 60*b* (slider ribs) which are fitted into the pair of grooves with which the cartridge 7 is provided, and a portion 60*c* for keeping the development roller 40 separated from the photosensitive drum 1 (this portion 60*c* hereafter will be referred to as separating portion 60*c*).

The protective cover 60 is attached to the cartridge 7 by sliding the sliding ribs 60*a* and 60*b* into the grooves 26*h* and 26*i*, with which the photosensitive member unit 26 of the cartridge 7 is provided. Thus, the protective cover 60 is slidable relative to the cartridge 7 in the lengthwise direction of the cartridge 7.

The separating portion 60*c* is at the upstream end in terms of the cartridge mounting direction, and extends perpendicularly downward from the main portion of the protective cover 60. The separating portion 60*c* remains sandwiched between the contact area 4*h* of the development unit 4 and the contact area 26*k* of the photosensitive drum 1 to keep the development unit 4 in the second separation position.

On the other hand, to the downstream end of the cartridge 7, a separating member 50 is attached to keep the development unit 4 in the position in which it keeps the development roller 40 separated from the photosensitive drum 1.

(Operation for Mounting Process Cartridge)

Figure 22:
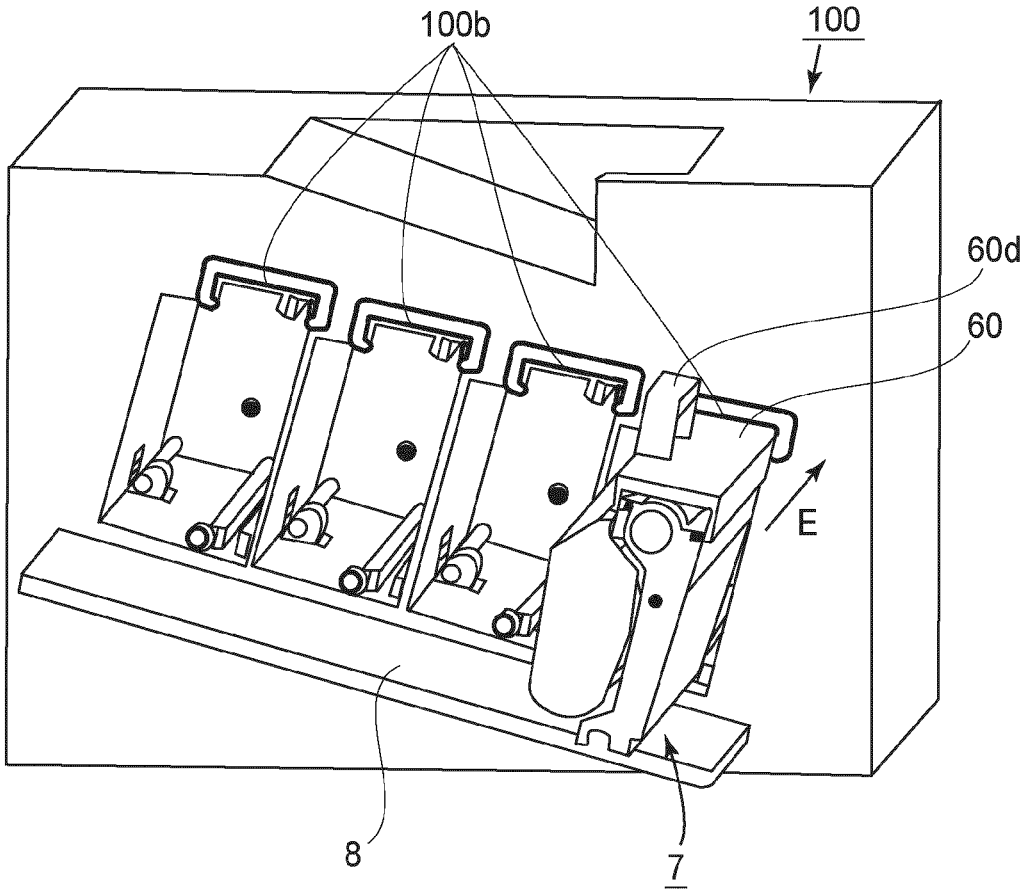
FIG. 22 is a perspective view of the process cartridge in the third embodiment of the present invention, and the main assembly of the image forming apparatus in the third embodiment, into which the process cartridge is being mounted.
Figure 23:
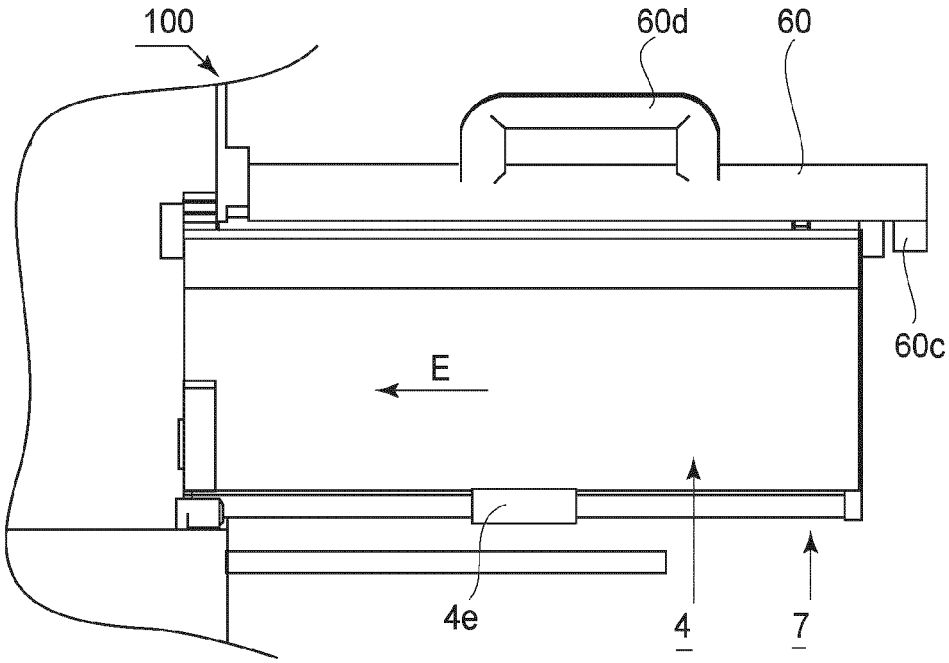
FIG. 23 is a cross-sectional view of the process cartridge in the third embodiment of the present invention, and the main assembly of the image forming apparatus in the third embodiment, into which the process cartridge is being mounted.
Figure 24:
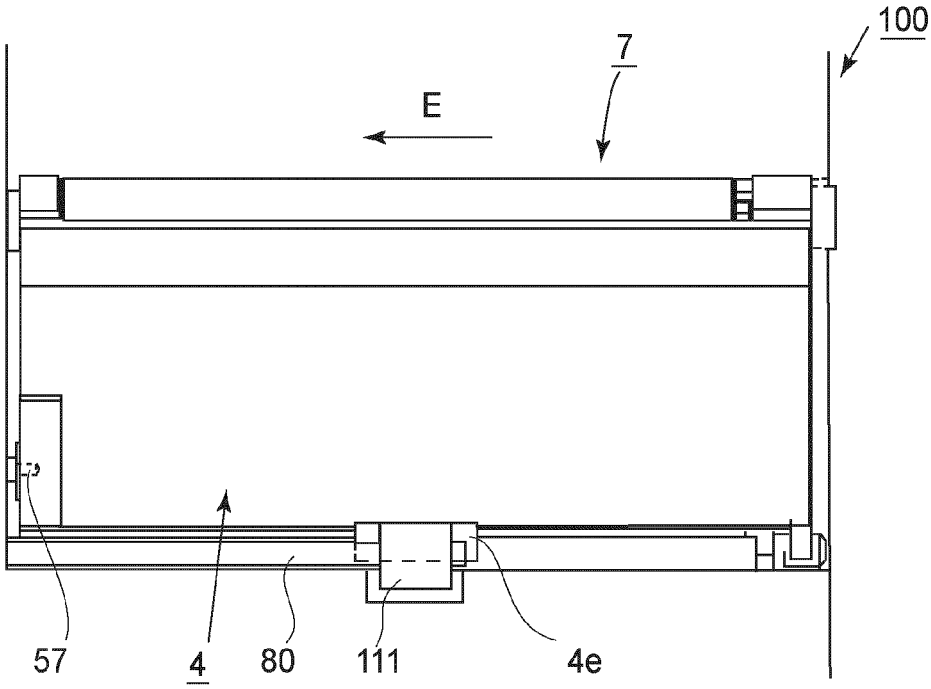
FIG. 24 is a sectional view of one of the process cartridge bays of the image forming apparatus in the third embodiment, and the process cartridge in the third embodiment, which has just been completely mounted into the bay.

FIG. 22 is a perspective view of the cartridge 7 which is being mounted into one of the cartridge bays 90. FIG. 23 is a side view (as seen from development unit side) of one of the cartridge bays 90 of the apparatus main assembly 100, and the cartridge 7 which is being mounted into the cartridge bay 90. FIG. 24 is a side view (as seen from development unit side) of one of the cartridge bays 90 of the apparatus main assembly 100, and the cartridge 7 which has just been completely mounted into the cartridge bay 90.

As will be evident from FIGS. 22 and 23, in order to properly mount the cartridge 7 into the apparatus main assembly 100, a user is to hold the cartridge 7 by the handle portion 60*d* of the protective cover 60, and to insert the cartridge 7 into the apparatus main assembly (cartridge bay 90) so that the protective cover 60 slides into the protective cover slot portion 100*b* of the apparatus main assembly (cartridge bay 90). Then, the cartridge 7 is to be inserted further into the apparatus main assembly (cartridge bay 90) by sliding the cartridge 7 relative to the protective cover 60.

Referring to FIG. 23, as the cartridge 7 is inserted further into the apparatus main assembly 100 by sliding the cartridge 7 along the protective cover 60, the separating portion 60*c* is disengaged from the contact area 4*h* of the development unit 4 and the contact area 26*k* of the cleaning unit 26. In other words, the upstream end of the development unit 4, in terms of the cartridge mounting direction, is freed from the separating portion 60*c*.

Then, the cartridge 7 is to be slid further into the apparatus main assembly after the development unit 4 is freed from the separating portion 60*c*. As the cartridge 7 is slid further into the apparatus main assembly 100, the protective cover 60 is disengaged from the cartridge 7.

During the above described movement of the cartridge 7, the separating member 50, that is, the separating member at the upstream end, in terms of the cartridge mounting direction, remains engaged. Therefore, the development unit 4 remains restricted in movement (being thereby kept in the position in which it keeps the development roller 40 separated from the photosensitive drum 1), at the upstream end. Then, as the cartridge 7 is inserted further into the position shown in FIG. 23, the separating member 50 comes into contact with the separating member disengaging portion 57 of the apparatus main assembly, and then, the separating member 50 is disengaged by the further insertion of the cartridge 7.

Incidentally, the disengagement of the separating member 50 occurs immediately before the completion of the operation for mounting the cartridge 7. Therefore, it is possible that immediately before and after the disengagement of the separating member 50, the positional relationship between the force bearing portion 4*e* of the development unit 4 and the separation cam 111 will be the same as that in the first embodiment or second embodiment. That is, in this embodiment, the force bearing portion 4*e* may come into contact with the separation cam 111 after the disengagement of the separating member 50, as in the case of the first embodiment, or before the disengagement of the separating member 50, as in the case of the second embodiment.

Thus, the relationship between the force bearing 4*e* and the separation cam 111 in this embodiment can provide the same effects as those provided in the first and second embodiment. That is, the process cartridge 7 and the image forming apparatus in this embodiment is significantly smaller in the amount of force required to mount the process cartridge 7 into the image forming apparatus, than a process cartridge and an image forming apparatus designed in accordance with the prior art. That is, the process cartridge 7 and the image forming apparatus in this embodiment are significantly superior to a process cartridge and an image forming apparatus designed in accordance with the prior art, in terms of the operability which concerns the operation which a user has to perform to mount the cartridge 7 into the image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 333026/2006 and 277091/2007 filed Dec. 11, 2006 and Oct. 25, 2007, respectively, which are hereby incorporated by reference.

What is claimed is:

1. An electrophotographic image forming apparatus capable of capable of forming an image on a recording material, comprising:

a process cartridge including an electrophotographic photosensitive member, a developing roller contactable to said electrophotographic photosensitive member, a spacer member movable between a spaced position for spacing said developing roller from said electrophotographic photosensitive member and a contacting position for contacting said developing roller to said electrophotographic photosensitive member, and a force receiving portion that receives a force for spacing said developing roller from said electrophotographic photosensitive member;

a mounting portion that detachably mounts said process cartridge;

an abutting member that retracts said spacer member from the spaced position by abutting said spacer member when said process cartridge is inserted into said mounting portion with said spacer member at the spaced position; and a function member movable between a first position for spacing said developing roller from said electrophotographic photosensitive member by abutting said force receiving portion with said process cartridge mounted to said mounting portion and a second position for contacting said developing roller to said electrophotographic photosensitive member, wherein when said process cartridge is inserted into said mounting portion with said spacer member at the spaced position, said abutting member is abutted to said spacer member to retract said spacer member from said spaced position after said process cartridge is inserted into said mounting portion to such a position where said function member taking the first position is abuttable to said force receiving portion.

2. An apparatus according to claim 1, where in a state in which said process cartridge is inserted into said mounting portion to such a position where said function member taking the first position is abuttable to said force receiving portion, said function member taking the first position and said force receiving portion are opposed to each other without abutment, and after said abutting member abuts said spacer member to retract said spacer member from said spaced position, said function member taking the first position abuts said force receiving portion without abutment between said developing roller and said electrophotographic photosensitive member.

3. An apparatus according to claim 2, wherein the distance between said developing roller and said electrophotographic photosensitive member spaced by said spacer member is larger than the distance between said developing roller and said electrophotographic photosensitive member spaced by said function member taking the first position.

4. An apparatus according to claim 1, wherein when said process cartridge is inserted into said mounting portion with said spacer member at the spaced position, said abutting member abuts said spacer member to retract said spacer member from said spaced position after said function member taking the first position abuts said force receiving portion.

5. An apparatus according to claim 4, wherein the distance between said developing roller and said electrophotographic photosensitive member spaced by said spacer member is smaller than the distance between said developing roller and said electrophotographic photosensitive member spaced by said function member taking the first position.

6. An apparatus according to claim 4 or 5, further comprising an inclined portion abutting on said force receiving portion and disposed upstream of said function member with respect to a mounting direction in which said mounting portion detachably mounts said process cartidge, that permits said force receiving portion to ride on said function member.

7. An apparatus according to claim 4 or 5, further comprising an inclined portion abutting on said function member and disposed upstream of said function member with respect to a mounting direction in which said mounting portion detachably mounts said process cartidge, that permits said force receiving portion to ride on said function member.

8. An apparatus according to claim 1, wherein said spacer member is provided on a frame of said process cartridge for movement between a spaced position and a retracted position retracted from said spaced position comprising the contacting position to abut said developing roller to said electrophotographic photosensitive member.

9. An apparatus according to claim 1, wherein said spacer member is detachably mountable to a frame of said process cartridge.

10. An apparatus according to claim 8 or 9, wherein said spacer member taking the spaced position covers said electrophotographic photosensitive member to protect said electrophotographic photosensitive member.

* * * * *